US010461420B2

(12) United States Patent
Chen

(10) Patent No.: US 10,461,420 B2
(45) Date of Patent: Oct. 29, 2019

(54) SWITCHABLE TRANSMIT AND RECEIVE PHASED ARRAY ANTENNA

(71) Applicant: THE BOEING COMPANY, Chicago, IL (US)

(72) Inventor: Ming Chen, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 355 days.

(21) Appl. No.: 15/161,110

(22) Filed: May 20, 2016

(65) Prior Publication Data

US 2016/0344098 A1 Nov. 24, 2016

Related U.S. Application Data

(63) Continuation-in-part of application No. 14/568,660, filed on Dec. 12, 2014, now Pat. No. 10,297,923.

(51) Int. Cl.

| | |
|---|---|
| ***H01Q 3/00*** | (2006.01) |
| ***H01Q 3/34*** | (2006.01) |
| ***H01Q 21/24*** | (2006.01) |
| ***H01Q 21/00*** | (2006.01) |
| *H01Q 1/42* | (2006.01) |
| *H01Q 1/38* | (2006.01) |
| *H01Q 3/24* | (2006.01) |

(Continued)

(52) U.S. Cl.

CPC ..... *H01Q 3/34* (2013.01); *H01Q 21/0087* (2013.01); *H01Q 21/245* (2013.01); *H01Q 1/38* (2013.01); *H01Q 1/42* (2013.01); *H01Q 1/523* (2013.01); *H01Q 3/24* (2013.01); *H01Q 21/0025* (2013.01); *H01Q 21/061* (2013.01)

(58) Field of Classification Search

CPC ..... H01Q 21/0025; H01Q 21/0087; H01Q 21/061; H01Q 21/064; H01Q 21/065; H01Q 21/245; H01Q 1/38; H01Q 1/523; H01Q 1/42; H01Q 9/0428; H01Q 9/0435; H01Q 3/24; H01Q 3/34

USPC ..... 342/371, 374; 343/776, 777

See application file for complete search history.

(56) References Cited

U.S. PATENT DOCUMENTS

| | | | |
|---|---|---|---|
| 5,644,277 | A | 7/1997 | Gulick et al. |
| 5,886,671 | A | 3/1999 | Riemer et al. |
| 6,580,402 | B2 | 6/2003 | Navarro et al. |

(Continued)

FOREIGN PATENT DOCUMENTS

| | | | |
|---|---|---|---|
| EP | 2763239 | A1 | 6/2014 |
| EP | 3032651 | A1 | 6/2016 |

OTHER PUBLICATIONS

European Intellectual Property Office Communication re Extended European Search Report, Application No. 15198241.0, dated Apr. 29, 2016.

(Continued)

*Primary Examiner* — Chuong P Nguyen

(74) *Attorney, Agent, or Firm* — Toler Law Group, PC

(57) ABSTRACT

A switchable transmit and receive phased array antenna ("STRPAA") is disclosed. The STRPAA includes a housing, a plurality of radiating elements, and a plurality of transmit and receive ("T/R") modules. The STRPAA may also include either a first multilayer printed wiring board ("MLPWB") configured to produce a first elliptical polarization or a second MLPWB configured to produce a second elliptical polarization within the housing.

15 Claims, 27 Drawing Sheets

(51) Int. Cl.
*H01Q 1/52* (2006.01)
*H01Q 21/06* (2006.01)

(56) References Cited

U.S. PATENT DOCUMENTS

| | | | | |
|---|---|---|---|---|
| 6,670,930 | B2 | 12/2003 | Navarro | |
| 6,989,791 | B2 | 1/2006 | Navarro et al. | |
| 7,450,068 | B2 | 11/2008 | Chen et al. | |
| 7,579,597 | B1 | 8/2009 | Bush | |
| 7,609,210 | B2 * | 10/2009 | Chen | H01P 5/103 343/700 MS |
| 7,868,830 | B2 | 1/2011 | Worl et al. | |
| 7,889,135 | B2 * | 2/2011 | Blaser | H01Q 21/064 343/700 MS |
| 7,893,867 | B2 * | 2/2011 | Navarro | G01S 7/006 342/157 |
| 7,989,791 | B2 | 8/2011 | Kang et al. | |
| 8,081,134 | B2 * | 12/2011 | Raby | H01Q 3/26 343/700 MS |
| 8,154,469 | B2 | 4/2012 | McKinley et al. | |
| 8,188,932 | B2 | 5/2012 | Worl et al. | |
| 8,643,548 | B2 * | 2/2014 | Worl | H01Q 23/00 343/700 MS |
| 9,172,145 | B2 * | 10/2015 | Puzella | H01Q 21/0025 |
| 9,472,843 | B2 | 10/2016 | Takeuchi et al. | |
| 9,761,939 | B2 * | 9/2017 | Pietila | H01Q 3/24 |
| 10,074,900 | B2 * | 9/2018 | Navarro | H01P 3/16 |
| 2005/0091844 | A1 | 5/2005 | Sathe et al. | |
| 2009/0143026 | A1 | 6/2009 | Jaffri et al. | |
| 2009/0284415 | A1 * | 11/2009 | Worl | H01Q 21/061 342/372 |
| 2010/0066631 | A1 * | 3/2010 | Puzella | H01Q 1/02 343/853 |
| 2010/0194640 | A1 | 8/2010 | Navarro | |
| 2016/0172755 | A1 | 6/2016 | Chen et al. | |
| 2016/0344098 | A1 | 11/2016 | Ming | |
| 2017/0005416 | A1 | 1/2017 | Gendron | |
| 2017/0237181 | A1 * | 8/2017 | Chen | H01Q 1/523 343/702 |

OTHER PUBLICATIONS

Canadian Examination Report dated Sep. 28, 2018 for application No. 2,915,243, 12 pgs.

Second Office Action and Search Report for Chinese Application No. 201510854557.6 dated Aug. 26, 2019, 13 pgs.

Communication pursuant to Article 94(3) EPC for Application No. 15198241.0 dated Aug. 22, 2019, 16 pgs.

* cited by examiner

SWITCHABLE TRANSMIT AND RECEIVE PHASED ARRAY ANTENNA

CROSS-REFERENCE TO RELATED APPLICATION AND CLAIM OF PRIORITY

The present patent application is a continuation-in-part ("CIP") application, claiming priority under 35 U.S.C. § 119(a) and 35 U.S.C. § 120, to U.S. patent application Ser. No. 14/568,660, filed on Dec. 12, 2014, titled "Switchable Transmit and Receive Phased Array Antenna," which is hereby incorporated by reference in its entirety.

BACKGROUND

1. Field

The present invention is related to phased-array antennas and, more particularly, to low-cost active-array antennas for use with high-frequency communication systems.

2. Related Art

Phased array antennas ("PAA") are installed on various mobile platforms (such as, for example, aircraft and land and sea vehicles) and provide these platforms with the ability to transmit and receive information via line-of-sight or beyond line-of-sight communications.

A PAA, also known as a phased antenna array, is a type of antenna that includes a plurality of sub-antennas (generally known as antenna elements, array elements, or radiating elements of the combined antenna) in which the relative amplitudes and phases of the respective signals feeding the array elements may be varied in a way that the effect on the total radiation pattern of the PAA is reinforced in desired directions and suppressed in undesired directions. In other words, a beam may be generated that may be pointed in or steered into different directions. Beam pointing in a transmit or receive PAA is achieved by controlling the amplitude and phase of the transmitted or received signal from each antenna element in the PAA.

The individual radiated signals are combined to form the constructive and destructive interference patterns produced by the PAA that result in one or more antenna beams. The PAA may then be used to point the beam, or beams, rapidly in azimuth and elevation.

Unfortunately, PAA systems are usually large and complex depending on the intended use of the PAA systems. Additionally, because of the complexity and power handling of known transmit and receive ("T/R") modules, many times PAA systems are designed with separate transmit modules and receive modules with corresponding separate PAA apertures. This further adds to the problems relating to cost and size of the PAA system. As such, for some applications, the amount of room for the different components of the PAA system may be limited and these designs may be too large to fit within the space that may be allocated for the PAA system.

In addition to producing one or more antenna beams, the PAA also produces these one or more antenna beams with a predetermined polarization that is determined by the design of the PAA. The polarization of the PAA is intrinsic and is a property of the radiated signals that are the radiated waves produced by the PAA. These radiated waves oscillate with a given orientation where the polarization of the PAA refers to the orientation of the electric field (i.e., the E-plane) of the radiated waves projected onto an imaginary plane perpendicular to the direction of motion of the radiated waves. Since most PAA are two-dimensional arrays, they typically produce elliptical polarization and generally the elliptical polarization is designed to simplify to circular polarization. This circular polarization may be "right-hand" circular polarization ("RHCP") or "left-hand" circular polarization ("LHCP"), where a PAA that transmits and/or receives RHCP signals cannot receive LHCP signals and, likewise, a PAA that transmits and/or receives LHCP signals cannot receive RHCP signals because both these situations describe cross-polarized signals situations. The terms left-hand and right-hand are designated based on utilizing the "thumb in the direction of the propagation" rule that is well known to those of ordinary skill in the art.

In order to operate with both RHCP and LHCP, many PAA systems are designed as polarization switchable PAA systems that may switch operation from RHCP to LHCP and wise-versa. A problem with these polarization switchable PAA systems is that they are typically complex and expensive and not well suited for more cost conscious uses. As such, at present, there are many situations where non-switchable PAA systems with fixed circular polarization (either RHCP or LHCP) are designed and used. Unfortunately, once a PAA system is designed with a fixed circular polarization, it is very difficult and costly to redesign that particular PAA system design to operate with the opposite fixed circular polarization because typically the change in the polarization design of the PAA system will require a redesign, requalification, and remanufacturing of the integrated circuit chipset, which will have a significant impact on the cost and production schedule of producing the new PAA system. This is a problem if the particular PAA system has been designed for a particular custom use and/or for a particular vehicle where a change of polarization is desired (either for a new mission, use, or upgrade) and other useable PAA system designs are not readily available.

Therefore, there is a need for an apparatus that overcomes the problems described above.

SUMMARY

Disclosed is a switchable transmit and receive phased array antenna ("STRPAA"). The STRPAA includes a housing, a plurality of radiating elements, and a plurality of transmit and receive ("T/R") modules. The STRPAA may also include either a first multilayer printed wiring board ("MLPWB") configured to produce a first elliptical polarization or a second MLPWB configured to produce a second elliptical polarization within the housing.

The first MLPWB includes a first MLPWB top surface and a first MLPWB bottom surface and the second MLPWB includes a second MLPWB top surface and a second MLPWB bottom surface. The plurality of radiating elements may be attached to either the first MLPWB top surface or the second MLPWB top surface. If attached to the first MLPWB top surface, the plurality of radiating elements are attached to the first MLPWB top surface at a predetermined azimuth position while, if attached to the second MLPWB top surface, the plurality of radiating elements are attached to the second MLPWB top surface at approximately 180 degrees in azimuth from the predetermined azimuth position. The plurality of T/R modules may be attached to either the first MLPWB bottom surface or the second MLPWB bottom surface, where the plurality of T/R modules are in signal communication with either the first MLPWB bottom surface or the second MLPWB bottom surface. Each T/R module of the plurality of T/R modules may be located on either the first MLPWB bottom surface opposite a corresponding radiating element of the plurality of radiating elements attached to the first MLPWB top surface or the second MLPWB bottom surface opposite the corresponding radiating element of the plurality of radiating elements attached to the second MLPWB top surface, where each T/R module is in signal communication with the corresponding radiating element located opposite the T/R module.

The STRPAA may be fabricated utilizing a method that includes inserting into the housing either the first MLPWB to configure the STRAA to produce the first elliptical polarization or the second MLPWB to configure the STRAA to produce the second elliptical polarization. The plurality of radiating elements are then attached either to a first MLPWB top surface of the first MLPWB if the first MLPWB is inserted in the housing or a second MLPWB top surface of the second MLPWB if the second MLPWB is inserted in the housing. The plurality of radiating elements may then be attached to the first MLPWB top surface at a predetermined azimuth position or the plurality of radiating elements are attached to the second MLPWB top surface after first rotating each element of the plurality of radiating elements, by approximately 180 degrees in azimuth, from the predetermined azimuth position, prior to attaching the plurality of radiating elements to the second MLPWB top surface. The plurality of T/R modules may then be attached to a first MLPWB bottom surface of the first MLPWB if the first MLPWB is inserted in the housing or to a second MLPWB bottom surface of the second MLPWB if the second MLPWB is inserted in the housing.

If already deployed in the field, the STRPAA may be converted to operate from a first elliptical polarization to a second elliptical polarization utilizing a conversion process. The process may include first detaching the radiating elements and T/R modules from the first MLPWB and removing the first MLPWB from the housing, where the MLPWB is configured to produce the first elliptical polarization. The process then includes inserting the second MLPWB into the housing, where the second MLPWB is configured to produce the second elliptical polarization. Moreover, the process includes attaching the detached radiating elements to the second MLPWB top surface of the second MLPWB and attaching the detached T/R modules to the second MLPWB bottom surface of the second MLPWB.

Other devices, apparatus, systems, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE FIGURES

The disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

Figure 1:
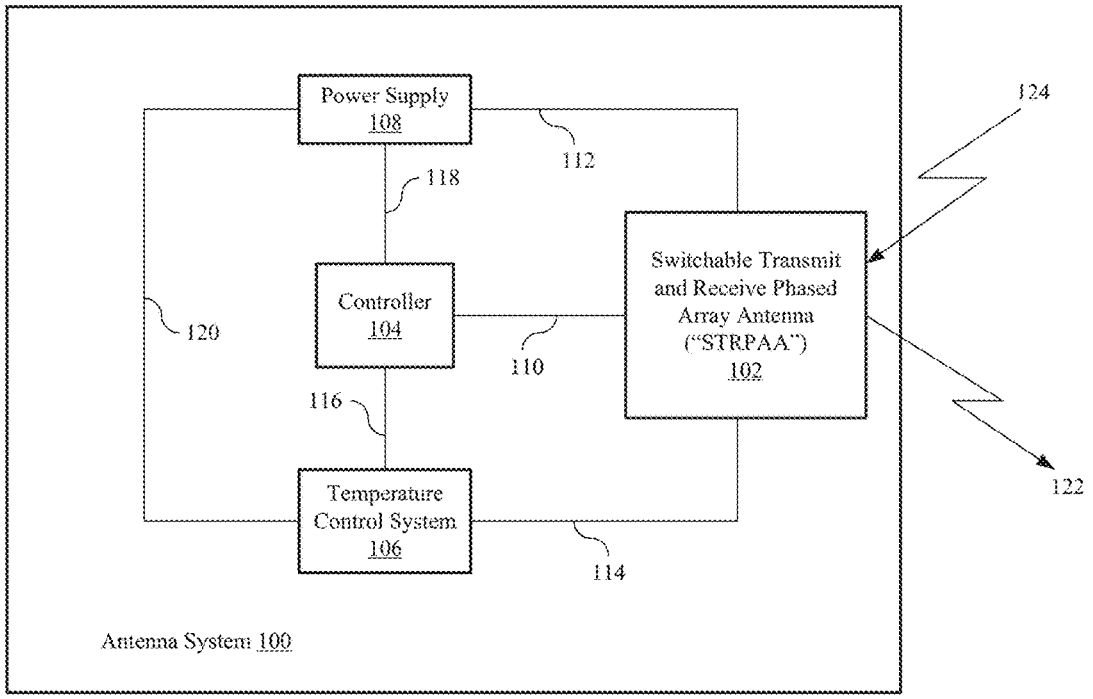
FIG. 1 is a system block diagram of an example of an implementation of antenna system in accordance with the present invention.

A switchable transmit and receive phased array antenna ("STRPAA") is disclosed. The STRPAA includes a housing, a plurality of radiating elements, and a plurality of transmit and receive ("T/R") modules. The STRPAA may also include either a first multilayer printed wiring board ("MLPWB") configured to produce a first elliptical polarization or a second MLPWB configured to produce a second elliptical polarization within the housing.

The first MLPWB includes a first MLPWB top surface and a first MLPWB bottom surface and the second MLPWB includes a second MLPWB top surface and a second MLPWB bottom surface. The plurality of radiating elements may be attached to either the first MLPWB top surface or the second MLPWB top surface. If attached to the first MLPWB top surface, the plurality of radiating elements are attached to the first MLPWB top surface at a predetermined azimuth position while, if attached to the second MLPWB top surface, the plurality of radiating elements are attached to the second MLPWB top surface at approximately 180 degrees in azimuth from the predetermined azimuth position. The plurality of T/R modules may be attached to either the first MLPWB bottom surface or the second MLPWB bottom surface, where the plurality of T/R modules are in signal communication with either the first MLPWB bottom surface or the second MLPWB bottom surface. Each T/R module of the plurality of T/R modules may be located on either the first MLPWB bottom surface opposite a corresponding radiating element of the plurality of radiating elements attached to the first MLPWB top surface or the second MLPWB bottom surface opposite the corresponding radiating element of the plurality of radiating elements attached to the second MLPWB top surface, where each T/R module is in signal communication with the corresponding radiating element located opposite the T/R module.

The STRPAA may be fabricated utilizing a method that includes inserting into the housing either the first MLPWB to configure the STRAA to produce the first elliptical polarization or the second MLPWB to configure the STRAA to produce the second elliptical polarization. The plurality of radiating elements are then attached either to a first MLPWB top surface of the first MLPWB if the first MLPWB is inserted in the housing or a second MLPWB top surface of the second MLPWB if the second MLPWB is inserted in the housing. The plurality of radiating elements may then be attached to the first MLPWB top surface at a predetermined azimuth position or the plurality of radiating elements are attached to the second MLPWB top surface after first rotating each element of the plurality of radiating elements, by approximately 180 degrees in azimuth, from the predetermined azimuth position, prior to attaching the plurality of radiating elements to the second MLPWB top surface. The plurality of T/R modules may then be attached to a first MLPWB bottom surface of the first MLPWB if the first MLPWB is inserted in the housing or to a second MLPWB bottom surface of the second MLPWB if the second MLPWB is inserted in the housing.

If already deployed in the field, the STRPAA may be converted to operate from a first elliptical polarization to a second elliptical polarization utilizing a conversion process. The process may include first detaching the radiating elements and T/R modules from the first MLPWB and removing the first MLPWB from the housing, where the MLPWB is configured to produce the first elliptical polarization. The process then includes inserting the second MLPWB into the housing, where the second MLPWB is configured to produce the second elliptical polarization. Moreover, the process includes attaching the detached radiating elements to the second MLPWB top surface of the second MLPWB and attaching the detached T/R modules to the second MLPWB bottom surface of the second MLPWB.

Turning to FIG. 1, a system block diagram of an example of an implementation of antenna system 100 is shown in accordance with the present invention. In this example, the antenna system 100 may include a STRPAA 102, controller 104, temperature control system 106, and power supply 108. The STRPAA 102 may be in signal communication with controller 104, temperature control system 106, and power supply 108 via signal paths 110, 112, and 114, respectively. The controller 104 may be in signal communication with the power supply 108 and temperature control system 106 via signal paths 116 and 118, respectively. The power supply 108 is also in signal communication with the temperature control system 106 via signal path 120.

In this example, the STRPAA 102 is a phased array antenna ("PAA") that includes a plurality of T/R modules with corresponding radiation elements that in combination are capable of transmitting 122 and receiving 124 signals through the STRPAA 102. In this example, the STRPAA 102 may be configured to operate within a K-band frequency range (i.e., about 20 GHz to 40 GHz for NATO K-band and 18 GHz to 26.5 GHz for IEEE K-band).

The power supply 108 is a device, component, and/or module that provides power to the other units (i.e., STRPAA 102, controller 104, and temperature control system 106) in the antenna system 100. Additionally, the controller 104 is a device, component, and/or module that controls the operation of the antennas system 100. The controller 104 may be a processor, microprocessor, microcontroller, digital signal processor ("DSP"), or other type of device that may either be programmed in hardware and/or software. The controller 104 may control the array pointing angle of the STRPAA 102, polarization, tapper, and general operation of the STRPAA 102.

The temperature control system 106 is a device, component, and/or module that is capable of controlling the temperature on the STRPAA 102. In an example of operation, when the STRPAA 102 heats up to a point when it needs some type of cooling, it may indicate this need to either the controller 104, temperature control system 106, or both. This indication may be the result of a temperature sensor within the STRPAA 102 that measures the operating temperature of the STRPAA 102. Once the indication of a need for cooling is received by either the temperature control system 106 or controller 104, the temperature control system 106 may provide the STRPAA 102 with the needed cooling via, for example, air or liquid cooling. In a similar way, the temperature control system 106 may also control the temperature of the power supply 108.

It is appreciated by those skilled in the art that the circuits, components, modules, and/or devices of, or associated with, the antenna system 100 are described as being in signal communication with each other, where signal communication refers to any type of communication and/or connection between the circuits, components, modules, and/or devices that allows a circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

Figure 2:
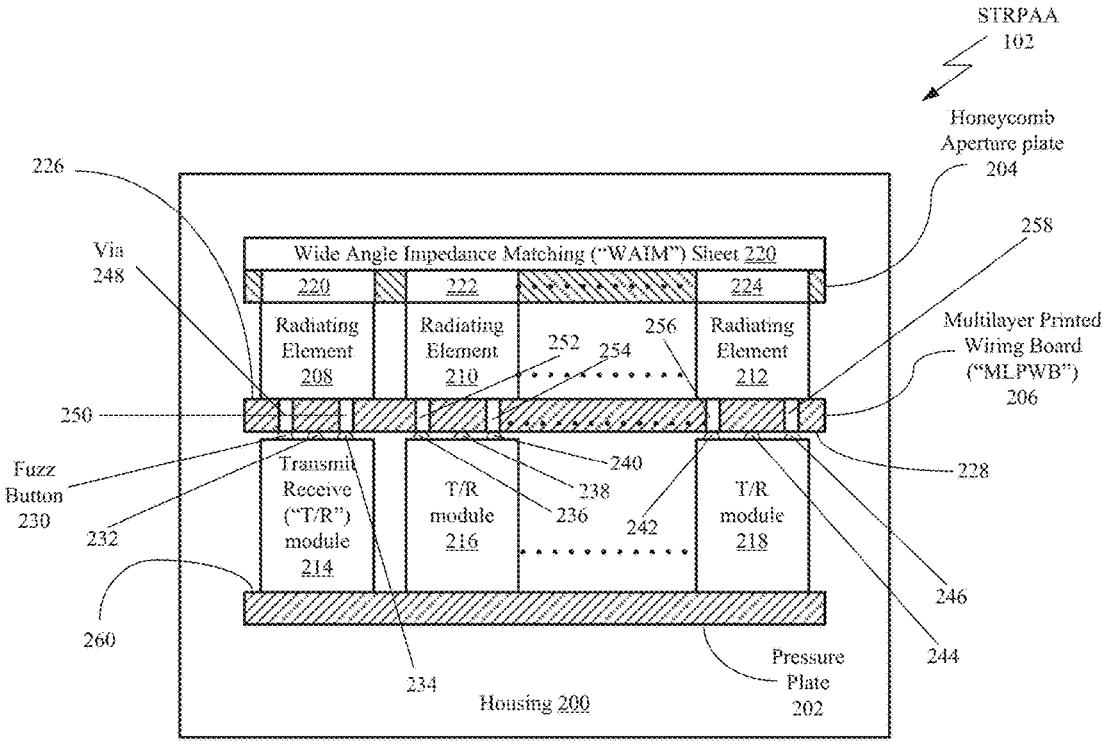
FIG. 2 is a block diagram of an example of an implementation of a switchable transmit and receive phased array antenna ("STRPAA"), shown in FIG. 1, in accordance with the present invention.

In FIG. 2, a block diagram of an example of an implementation of the STRPAA 102 is shown in accordance with the present invention. The STRPAA 102 may include a housing 200, a pressure plate 202, honeycomb aperture plate 204, a MLPWB 206, a plurality of radiating elements 208, 210, and 212, a plurality of T/R modules 214, 216, and 218, and wide angle impedance matching ("WAIM") sheet 220. In this example, the housing 200 may be formed by the combination of the pressure plate 202 and honeycomb aperture plate 204.

The honeycomb aperture plate 204 may be a metallic or dielectric structural plate that includes a plurality of channels 220, 222, and 224 through the honeycomb aperture plate 204 where the plurality of channels define the honeycomb structure along the honeycomb aperture plate 204. The WAIM sheet 220 is then attached to the top or outer surface of the honeycomb aperture plate 204. In general, the WAIM sheet 220 is a sheet of non-conductive material that includes a plurality of layers that have been selected and arranged to minimize the return loss and to optimize the impedance match between the STRPAA 102 and free space so as to allow improved scanning performance of the STRPAA 102.

The MLPWB 206 (also known as multilayer printed circuit board) is a printed wiring board ("PWB") (also known as a printed circuit board—"PCB") that includes multiple trace layers inside the PWB. In general, it is a stack up of multiple PWBs that may include etched circuitry on both sides of each individual PWB where lamination may be utilized to place the multiple PWBs together. The resulting MLPWB allows for much higher component density than on a signal PWB.

In this example, the MLPWB 206 has two surfaces a top 226 surface (i.e., a MLPWB top surface) and a bottom surface 228 (i.e., a MLPWB bottom surface) having etched electrical traces on each surface 226 and 228. The plurality of T/R modules 214, 216, and 218 may be attached to the bottom surface 228 of the MLPWB 206 and the plurality of radiating elements 208, 210, and 212 may be attached to the top surface 226 of the MLPWB 206. In this example, the plurality of T/R modules 214, 216, and 218, may be in signal communication with the bottom surface 228 of the MLPWB 206 via a plurality of conductive electrical interconnects 230, 232, 234, 236, 238, 240, 242, 244, and 246, respectively.

In one embodiment, the electrical interconnects may be embodied as "fuzz Buttons®". It is appreciated to those of ordinary skill in the art that in general, a "fuzz Button®" is a high performance "signal contact" that is typically fashioned from a single strand of gold-plated beryllium-copper wire formed into a specific diameter of dense cylindrical material, ranging from a few tenths of a millimeter to a millimeter. They are often utilized in semiconductor test sockets and PWB interconnects where low-distortion transmission lines are a necessity. In another embodiment, the electrical interconnects may be implemented by solder utilizing a ball grid array of solder balls that may be reflowed to form the permanent contacts.

The radiating elements 208, 210, and 212 may be separate modules, devices, and/or components that are attached to the top surface 226 of the MLPWB 206 or they may actually be part of the MLPWB 206 as etched elements on the surface of the top surface 226 of the MLPWB 206 (such as, for example, a microstrip/patch antenna element). In the case of separate modules, the radiating elements 208, 210, 212 may be attached to the top surface 226 of the MLPWB 206 utilizing the same techniques as utilized in attaching the plurality of T/R modules 214, 216, and 218 on the bottom surface 228 of the MLPWB 206 including the use of electrical interconnects (not shown).

In either case, the plurality of radiating elements 208, 210, and 212 are in signal communication with the plurality of T/R modules 214, 216, and 218 through a plurality of conductive channels (herein referred to as "via" or "vias") 248, 250, 252, 254, 256, and 258 through the MLPWB 206, respectively. In this example, each radiating element 208, 210, and 212 is in signal communication with a corresponding individual T/R module 214, 216, and 218 that is located on the opposite surface of the MLPWB 206. Additionally, each radiating element 208, 210, and 212 will correspond to an individual channel 220, 222, and 224. The vias 248, 250, 252, 254, 256, and 258 may include conductive metallic and/or dielectric material. In operation, the radiating elements may transmit and/or receive wireless signals such as, for example, K-band signals.

It is appreciated by those of ordinary skill in the art that the term "via" or "vias" is well known. Specifically, a via is an electrical connection between layers in a physical electronic circuit that goes through the plane of one or more adjacent layers, in this example the MLPWB 206 being the physical electronic circuit. Physically, the via is a small conductive hole in an insulating layer that allows a conductive connection between the different layers in MLPWB 206. In this example, the vias 248, 250, 252, 254, 256, and 258 are shown as individual vias that extend from the bottom surface 228 of the MLPWB 206 to the top surface 226 of the MLPWB 206, however, each individual via may actually be a combined via that includes multiple sub-vias that individually connect the individual multiple layers of the MLPWB 206 together.

The MLPWB 206 may also include a radio frequency ("RF") distribution network (not shown) within the layers of the MLPWB 206. The RF distribution network may be a corporate feed network that uses signal paths to distribute the RF signals to the individual T/R modules of the plurality of T/R modules. As an example, the RF distribution network may include a plurality of stripline elements and Wilkinson power combiners/dividers.

It is appreciated by those of ordinary skill in the art that for the purposes of simplicity in illustration only three radiating elements 208, 210, 212 and three T/R modules 214, 216, and 218 are shown. Furthermore, only three channels 220, 222, and 224 are shown. However, it is appreciated that there may be many more radiating elements, T/R modules, and channels than what is specifically shown in FIG. 2. As an example, the STRPAA 102 may include PAA with 256 array elements which would mean that STRPAA 102 would include 256 radiating elements, 256 T/R modules, and 256 channels through the honeycomb aperture plate 204.

Additionally, it is also appreciated that only two vias 248, 250, 252, 254, 256, and 258 are shown per pair combination of the radiating elements 208, 210, and 212 and the T/R modules 214, 216, and 218. In this example, the first via per combination pair may correspond to a signal path for a first polarization signal and the second via per combination pair may correspond to a signal path for a second polarization signal. However, it is appreciated that there may additional vias per combination pair.

In this example, referring back to the honeycomb aperture plate 204, the channels 220, 222, and 224 act as waveguides for the corresponding radiating elements 208, 210, and 212. As such, the channels 220, 222, and 224 may be air, gas, or dielectric filled.

The pressure plate 202 may be a part of the housing 200 that includes inner surface 260 that butts up to the bottom of the plurality of T/R modules 214, 216, and 218 and pushes them against the bottom surface 228 of the MLPWB 206. The pressure plate 202 may also include a plurality of compression springs (not shown) along the inner surface 260 that apply additional force against the bottoms of the T/R modules 214, 216, and 218 to push them against the bottom surface 228 of the MLPWB 206.

Figure 3:
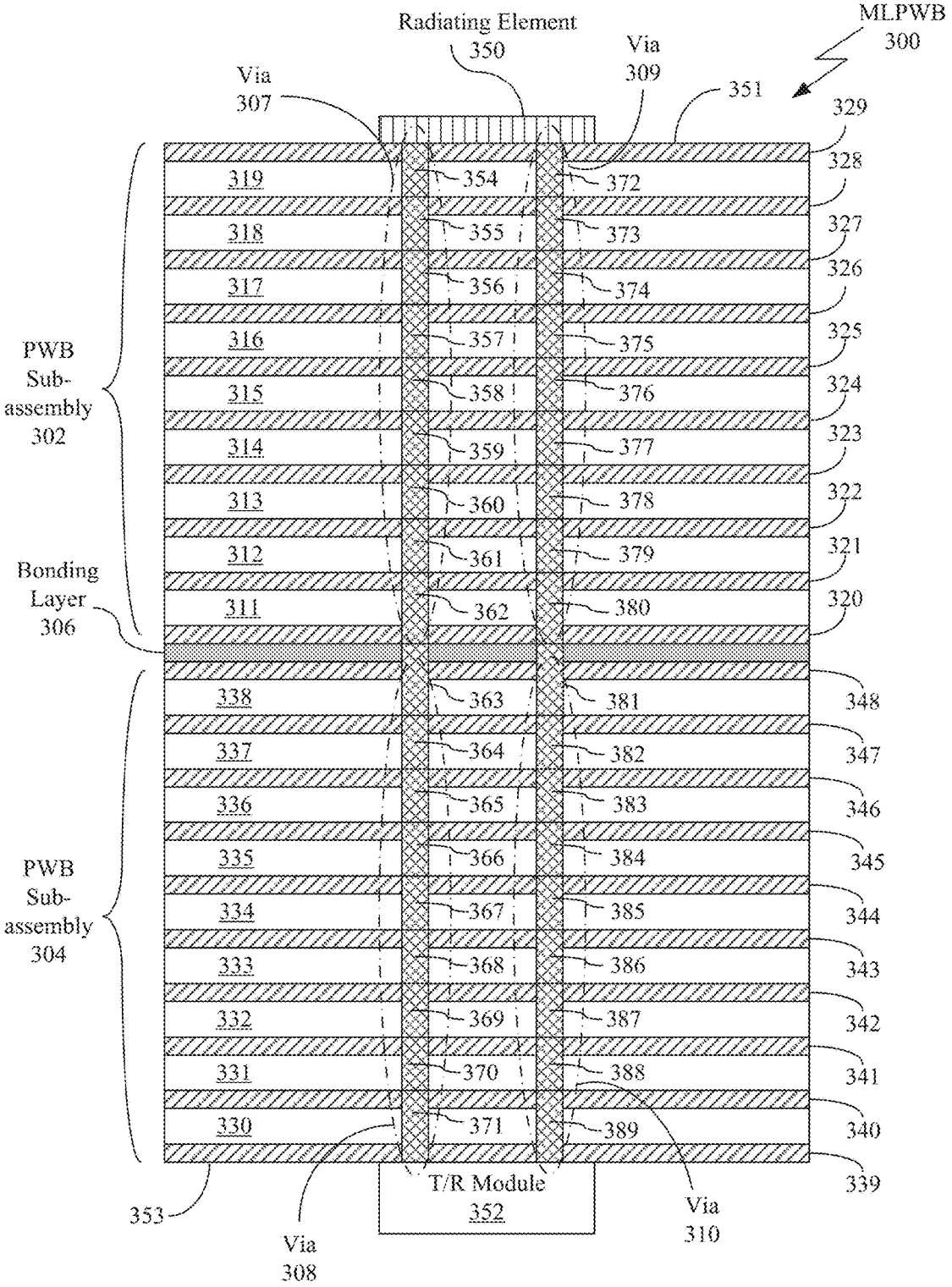
FIG. 3 is a partial cross-sectional view of an example of an implementation of a multilayer printed wiring board ("MLPWB"), shown in FIG. 2, in accordance with the present invention.

In FIG. 3, a partial cross-sectional view of an example of an implementation of the MLPWB 300 is shown in accordance with the present invention. The MLPWB 300 is an example of MLPWB 206 shown in FIG. 2. In this example, the MLPWB 300 may include two PWB sub-assemblies 302 and 304 that are bonded together utilizing a bonding layer 306.

The bonding layer 306 provides mechanical bonding as well as electrical properties to electrically connect via 307 and via 308 to each other and via 309 and 310 to each other. As an example, the bonding layer 306 may be made from a bonding material, such as bonding materials provided by Ormet Circuits, Inc.® of San Diego, Calif., for example, FR-408HR. The thickness of the bonding layer 306 may be, for example, approximately 4 thousandth of an inch ("mils").

In this example, the first PWB sub-assembly 302 may include nine (9) substrates 311, 312, 313, 314, 315, 316, 317, 318, and 319. Additionally, ten (10) metallic layers (for example, copper) 320, 321, 322, 323, 324, 325, 326, 327, 328, and 329 insolate the nine substrates 311, 312, 313, 314, 315, 316, 317, 318, and 319 from each other. Similarly, the second PWB sub-assembly 304 may also include nine (9) substrates 330, 331, 332, 333, 334, 335, 336, 337, and 338. Additionally, ten (10) metallic layers (for example, copper) 339, 340, 341, 342, 343, 344, 345, 346, 347, and 348 insolate the nine substrates 330, 331, 332, 333, 334, 335, 336, 337, and 338 from each other. In this example, the bonding layer 306 bounds metallic layer 320 to metallic layer 348.

In this example, similar to the example described in FIG. 2, a radiating element 350 is shown as attached to a top surface 351 of the MLPWB 300 and a T/R module 352 is shown attached to a bottom surface 353 of the MLPWB 300. The top surface 351 corresponds to the top surface of the metallic layer 329 and the bottom surface 353 corresponds to the bottom surface of the metallic layer 339. As in FIG. 2, the T/R module 352 is shown to be in signal communication with the radiating element 350 through the combination of vias 307 and 308 and vias 309 and 310, where vias 307 and 308 are in signal communication through the bonding layer 306 and vias 309 and 310 are also in signal communication through the bonding layer 306. It is appreciated that via 307 may include sub-vias (also known as "buried vias") 354, 355, 356, 357, 358, 359, 360, 361, and 362 and via 308 may include sub-vias 363, 364, 365, 366, 367, 368, 369, 370, and 371. Similarly, via 309 may include sub-vias (also known as "buried vias") 372, 373, 374, 375, 376, 377, 378, 379, and 380 and via 310 may include sub-vias 381, 382, 383, 384, 385, 386, 387, 388, and 389. In this example, the metallic layers 320, 321, 322, 323, 324, 325, 326, 327, 328, 329, 339, 340, 341, 342, 343, 344, 345, 346, 347, and 348 may be electrically grounded layers. They may have a thickness that varies between approximately 0.7 to 2.8 mils. The substrates 311, 312, 313, 314, 315, 316, 317, 318, 319, 330, 331, 332, 333, 334, 335, 336, 337, and 338 may be, for example, a combination of RO4003C, RO4450F, and RO4450B produced by Rogers Corporation® of Rogers of Connecticut. The substrates 311, 312, 313, 314, 315, 316, 317, 318, 319, 330, 331, 332, 333, 334, 335, 336, 337, and 338 may have a thickness that varies between approximately 4.0 to 16.0 mils.

In this example, the diameters of vias 307 and 308 and vias 309 and 310 may be reduced as opposed to having a single pair of vias penetrate the entire MLPWB 300 as has been done in conventional architectures. In this manner, the size of the designs and architectures on MLPWB 300 may be reduced in size to fit more circuitry with respect to radiating elements (such as radiating element 350). As such, in this approach, the MLPWB 300 may allow more and/or smaller radiating elements to be placed on top surface 351 of the MLPWB 300.

For example, as stated previously, radiating element 350 may be formed on or within the top surface 351 of the MLPWB 300. The T/R module 352 may be mounted on the bottom surface 353 of the MLPWB 300 utilizing electrical interconnect signal contacts. In this manner, the radiating element 350 may be located opposite of the corresponding T/R module 352 in a manner that does not require a 90-degree angle or bend in the signal path connecting the T/R module 352 to the radiating element 350. More specifically, the radiating element 350 may be substantially aligned with the T/R module 352 such that the vias 307, 308, 309, and 310 form a straight line path between the radiating element 350 and the T/R module.

Figure 4:
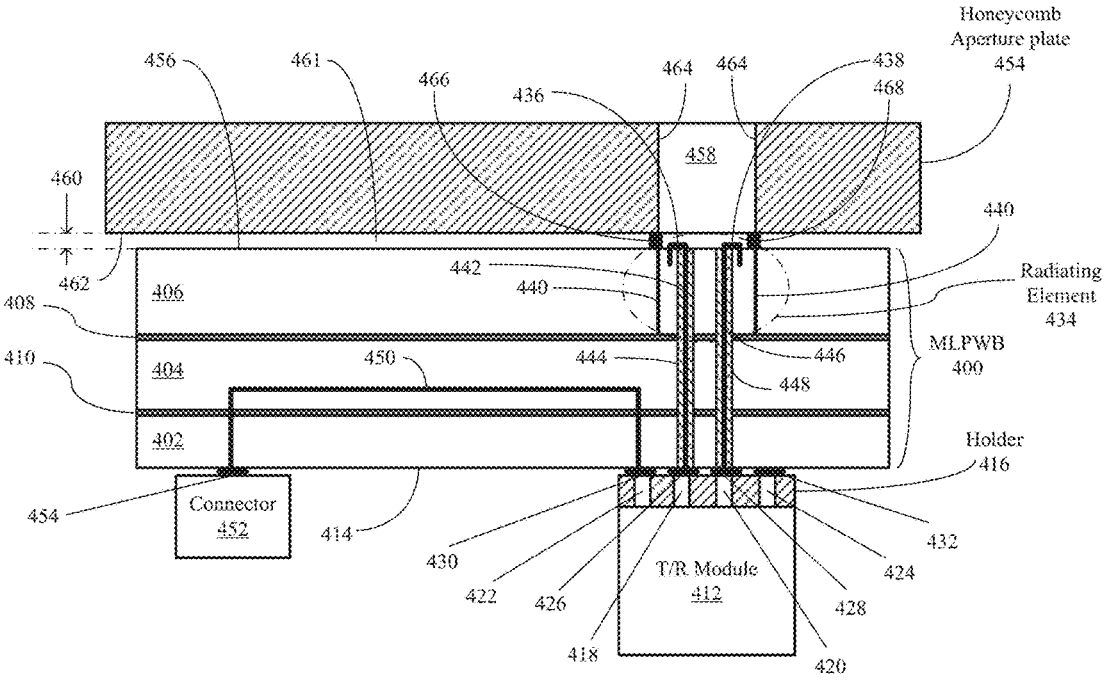
FIG. 4 is a partial side-view of an example of an implementation of the MLPWB in accordance with the present invention.

Turning to FIG. 4, a partial side-view of an example of an implementation of the MLPWB 400 is shown in accordance with the present invention. The MLPWB 400 is an example of MLPWB 206 shown in FIG. 2 and the MLPWB 300 shown in FIG. 3. In this example, the MLPWB 400 only shows three (3) substrate layers 402, 404, and 406 instead of the twenty (20) shown the in MLPWB 300 of FIG. 2. Only two (2) metallic layers 408 and 410 are shown around substrate 404. Additionally, the bonding layer is not shown. A T/R module 412 is shown attached to a bottom surface 414 of the MLPWB 400 through a holder 416 that includes a plurality of electrical interconnect signal contacts 418, 420, 422, and 424. The electrical interconnect signal contacts 418, 420, 422, and 424 may be in signal communication with a plurality of formed and/or etched contact pads 426, 428, 430, and 432, respectively, on the bottom surface 414 of the MLPWB 400.

In this example, a radiating element 434 is shown formed in the MLPWB 400 at substrate layer 406, which may be embodied as a printed antenna. The radiation element 434 is shown to have two radiators 436 and 438, which may be etched into layer 406. As an example, the first radiator 436 may radiate a first type of polarization (such as, for example, vertical polarization or right-hand circular polarization) and the second radiator 438 may radiate a second type of polarization (such as, for example, horizontal polarization or left-hand circular polarization) that is orthogonal to the first polarization. The radiating element 434 may also include grounding, reflecting, and/or isolation elements 440 to improve the directivity and/or reduce the mutual coupling of the radiating element. The first radiator 436 may be fed by a first probe 442 that is in signal communication with the contact pad 426, through a first via 444, which is in signal communication with the T/R module 412 through the electrical interconnect signal contact 418. Similarly, the second radiator 438 may be fed by a second probe 446 that is in signal communication with the contact pad 428, through a second via 448, which is in signal communication with the T/R module 412 through the electrical interconnect signal contact 420. In this example, the first via 444 may be part of, or all of, the first probe 442 based on how the architecture of the radiating element 434 is designed in substrate layer 406. Similarly, the second via 448 may also be part of, or all of, the second probe 446. The first and second probes 442 and 446 are generally feeds points for the first and second radiators 436 and 438.

In this example, a RF distribution network 450 is shown. An RF connector 452 is also shown in signal communication with the RF distribution network 450 via contact pad 454 on the bottom surface 414 of the MLPWB 400. As discussed earlier, the RF distribution network 450 may be a stripline distribution network that includes a plurality of power combiner and/or dividers (such as, for example, Wilkinson power combiners) and stripline terminations. The RF distribution network 450 is configured to feed a plurality of T/R modules attached to the bottom surface 414 of the MLPWB 400. In this example, the RF connector 452 may be a SMP-style miniature push-on connector such as, for example, a G3PO® type connector produced by Corning Gilbert Inc.® of Glendale, Ariz. or other equivalent high-frequency connectors, where the port impedance is approximately 50 ohms.

In this example, a honeycomb aperture plate 454 is also shown placed adjacent to the top surface 456 of the MLPWB 400. The honeycomb aperture plate 454 is a partial view of the honeycomb aperture plate 204 shown in FIG. 2. The honeycomb aperture plate 454 includes a channel 458 and that is located adjacent the radiating element 434. In this example, the channel 458 may be cylindrical and act as a circular waveguide horn for the radiating element 434. The honeycomb aperture plate 454 may be spaced a small distance 460 away from the top surface 456 of the MLPWB 400 to form an air-gap 461 that may be utilized to tune radiation performance of the combined radiating element 434 and channel 458. As an example, the air-gap 461 may have a width 460 that is approximately 0.005 inches. In this example, the radiating element 434 include grounding elements 440 that act as ground contacts that are placed in signal communication with the bottom surface 462 of the honeycomb aperture plate 454 via contact pads 466 and 468 (points to gap between 466 and 468) that protrude from the top surface 456 of the MLPWB 400 and press against the bottom surface 462 of the honeycomb aperture plate 454. In this fashion, the inner walls 464 of the channel 458 are grounded and the height of the contact pads 466 and 468 correspond to the width 460 of the air-gap 461.

Figure 5:
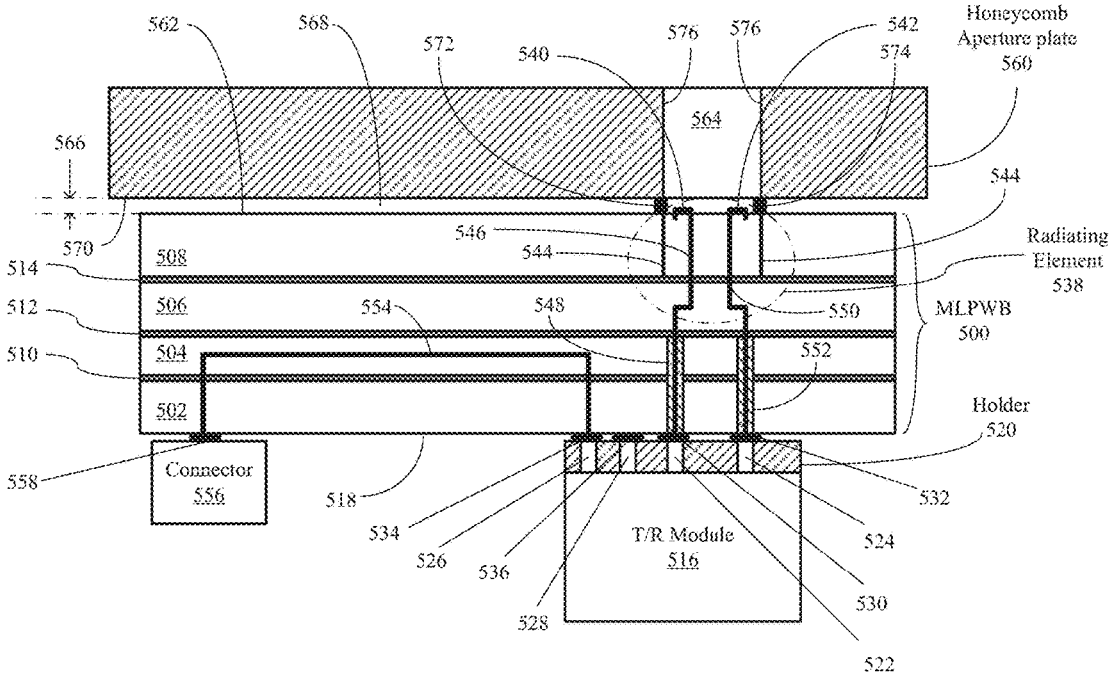
FIG. 5 is a partial side-view of an example of another implementation of the MLPWB in accordance with the present invention.

Similar to FIG. 4, in FIG. 5, a partial side-view of an example of another implementation of the MLPWB 500 is shown in accordance with the present invention. The MLPWB 500 is an example of MLPWB 206 shown in FIG. 2, the MLPWB 300 shown in FIG. 3, and the MLPWB 400 shown in FIG. 4. In this example, the MLPWB 500 only shows four (4) substrate layers 502, 504, 506, and 508 instead of the twenty (20) shown in the MLPWB 300 of FIG. 2.

Only three (3) metallic layers 510, 512, and 514 are shown around substrates 504 and 506. Additionally, the bonding layer is not shown. A T/R module 516 is shown attached to the bottom surface 518 of the MLPWB 500 through the holder 520 that includes a plurality of electrical interconnect signal contacts 522, 524, 526, and 528. The electrical interconnect signal contacts 522, 524, 526, and 528 may be in signal communication with a plurality of formed and/or etched contact pads 530, 532, 534, and 536, respectively, on the bottom surface 518 of the MLPWB 500.

In this example, the radiating element 538 is shown formed in the MLPWB 500 at substrate layer 508 such as a microstrip antenna which may be etched into layer 508. Similar to FIG. 4, the radiation element 538 is shown to have two radiators 540 and 542. Again as in the example described in FIG. 4, the first radiator 540 may radiate a first type of polarization (such as, for example, vertical polarization or right-hand circular polarization) and the second radiator 542 may radiate a second type of polarization (such as, for example, horizontal polarization or left-hand circular polarization) that is orthogonal to the first polarization. The radiating element 538 may also include grounding elements 544. The first radiator 540 may be fed by a first probe 546 that is in signal communication with the contact pad 530, through a first via 548, which is in signal communication with the T/R module 516 through the electrical interconnect signal contact 522. Similarly, the second radiator 542 may be fed by a second probe 550 that is in signal communication with the contact pad 532, through a second via 552, which is in signal communication with the T/R module 516 through the electrical interconnect signal contact 524. Unlike the example described in FIG. 4, in this example the first via 548 and second via 552 are partially part of the first probe 546 and second probe 550, respectively. Additionally, in this example, the first probe 546 and second probe 550 include 90-degree bends in substrate 506.

Similar to the example in FIG. 4, in this example, a RF distribution network 554 is also shown. An RF connector 556 is also shown in signal communication with the RF distribution network 554 via contact pad 558 on the bottom surface 518 of the MLPWB 500. Again, the RF distribution network 554 is configured to feed a plurality of T/R modules attached to the bottom surface 518 of the MLPWB 500. In this example, the RF connector 556 may be also a SMP-style miniature push-on connector such as, for example, a G3PO® type connector or other equivalent high-frequency connectors, where the port impedance is approximately 50 ohms.

In this example, a honeycomb aperture plate 560 is also shown placed adjacent to the top surface 562 of the MLPWB 500. Again, the honeycomb aperture plate 560 is a partial view of the honeycomb aperture plate 204 shown in FIG. 2. The honeycomb aperture plate 560 includes a channel 564 and the channel 564 is located adjacent the radiating element 538. Again, the channel 564 may be cylindrical and act as a circular waveguide horn for the radiating element 538. The honeycomb aperture plate 560 may be also spaced a small distance 566 away from the top surface 562 of the MLPWB 500 to form the air-gap 568 that may be utilized to tune radiation performance of the combined radiating element 538 and channel 564. As an example, the air-gap 568 may have a width 566 that is approximately 0.005 inches. In this example, the grounding elements 544 act as ground contacts that are placed in signal communication with the bottom surface 570 of the honeycomb aperture plate 560 via contact pads 572 and 574 that protrude from the top surface 562 of the MLPWB 500 and press against the bottom surface 570 of the honeycomb aperture plate 560. In this fashion, the inner walls 576 of the channel 564 are grounded and the height of the contact pads 572 and 574 correspond to the width 566 of the air-gap 568.

Figure 6:
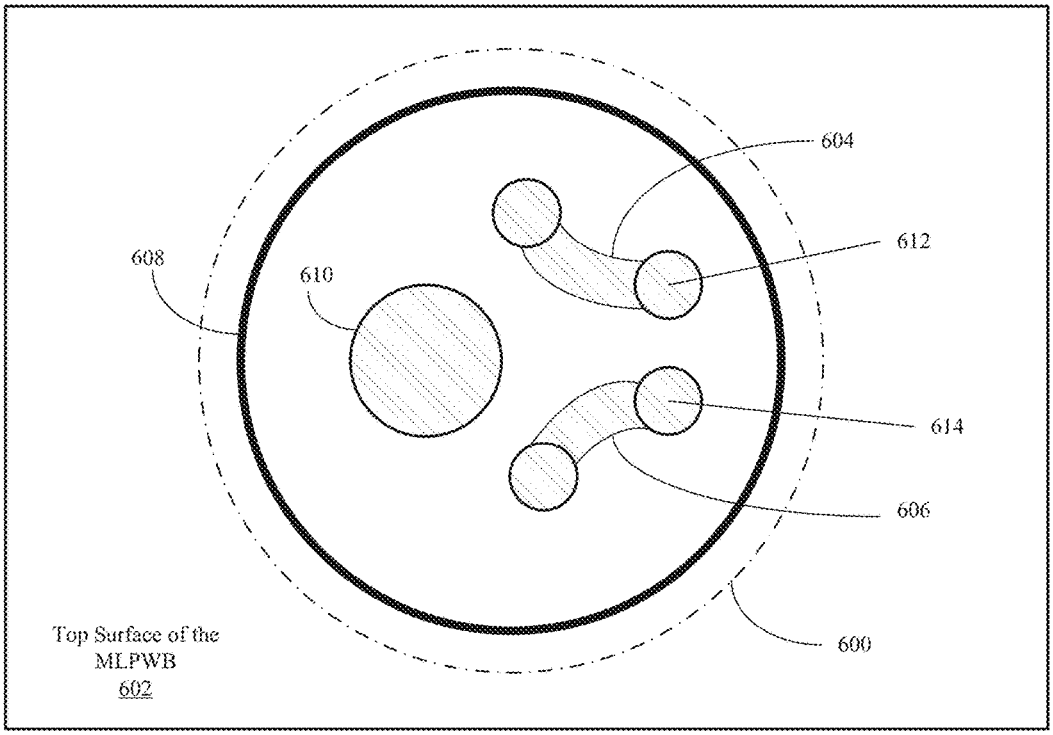
FIG. 6 is a top view of an example of an implementation of a radiating element, shown in FIGS. 2, 3, 4, and 5, in accordance with the present invention.

Turning to FIG. 6, a top view of an example of an implementation of a radiating element 600, that can be used with any of the MLPWB's 206, 300, 400, or 500 described above. As was described earlier (in relation to FIG. 2), a radiating element (such as radiating elements 208, 210, and 212) may be separate modules, devices, and/or components that are attached to the top surface 226 of the MLPWB 206 or they may actually be part of the MLPWB 206 as etched elements on the surface of the top surface 226 of the MLPWB 206 (such as, for example, a microstrip/patch antenna element). In this example, the radiating element 600 in formed and/or etched on the top surface 602 of the MLPWB. As described in FIGS. 4 and 5, the radiating element 600 may include a first radiator 604 and second radiator 606. The first radiator 604 is fed by at a first feed point 612 that is fed by a first probe (not shown) that is in signal communication with the T/R module (not shown) and the second radiator 606 is fed by a second feed point 614 that is fed by a second probe (not shown) that is also in signal communication with the T/R module (not shown) as previously described in FIGS. 4 and 5. As described previously, the first radiator 604 may radiate a first type of polarization (such as, for example, vertical polarization or right-hand circular polarization) and the second radiator 606 may radiate a second type of polarization (such as, for example, horizontal polarization or left-hand circular polarization) that is orthogonal to the first polarization. Also shown in this example is grounding element 608, or elements, described in FIGS. 4 and 6. The grounding element(s) 608 may include a plurality of contact pads (not shown) that protrude out from the top surface 602 of the MLPWB to engage the bottom surface (not shown) of the honeycomb aperture plate (not shown) to properly ground the walls of the channel (not shown) that is located adjacent to the radiating element 600. Additionally, a ground via 610 may be radiating element 600 to help tune the radiator bandwidth.

Figures 7A, 7B:
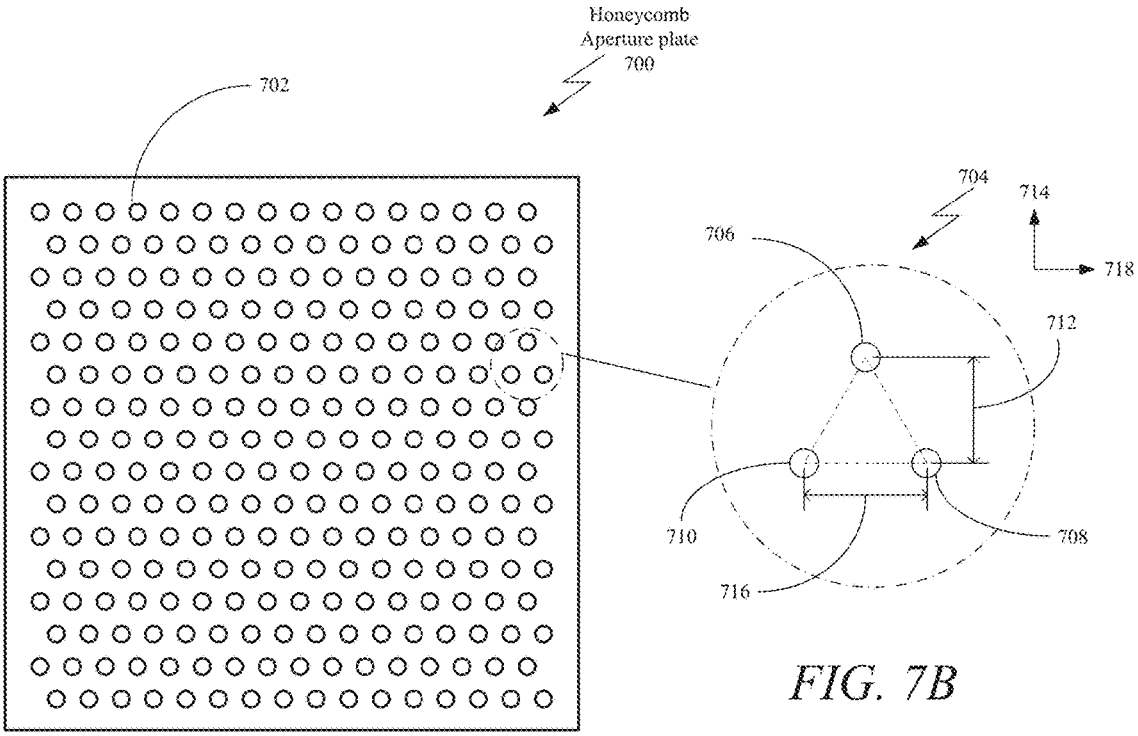
FIG. 7A is a top view of an example of an implementation of a honeycomb aperture plate layout, shown in FIGS. 2, 4 and 5, in accordance with the present invention.
FIG. 7B is a top view of a zoomed-in portion of the honeycomb aperture plate shown in FIG. 7A.

In FIG. 7A, a top view of an example of an implementation of honeycomb aperture plate 700 is shown in accordance with the present invention. The honeycomb aperture plate 700 is shown having a plurality of channels 702 distributed in lattice structure of a PAA. In this example, the STRPAA may include a 256 element PAA, which would result in the honeycomb aperture plate 700 having 256 channels 702. Based on a 256 element PAA, the lattice structure of the PAA may include a PAA having 16 by 16 elements, which would result in the honeycomb aperture plate 700 having 16 by 16 channels 702 distributed along the honeycomb aperture plate 700.

Turning to FIG. 7B, a top view of a zoomed-in portion 704 of the honeycomb aperture plate 700 is shown. In this example, the zoomed-in portion 704 may include three (3) channels 706, 708, and 710 distributed in a lattice. In this example, if the diameters of channels 706, 708, and 710 are approximately equal to 0.232 inches, permittivity ("$\varepsilon_r$") of channels 706, 708, and 710 are equal to approximately 2.5, and STRPAA is a K-band antenna operating in a frequency range of 21 GHz to 22 GHz with a waveguide cutoff frequency (for the waveguides formed by the channels 706, 708, and 710) of approximately 18.75 GHz, then the distance 712 in the x-axis 714 (i.e., between the centers of the first channel 706 and second and third channels 708 and 710) may be approximately equal to 0.302 inches and the distance 716 in the y-axis 718 (i.e., between the centers of the second channel 708 and third channel 710) may be approximately equal to 0.262 inches.

Figure 8:
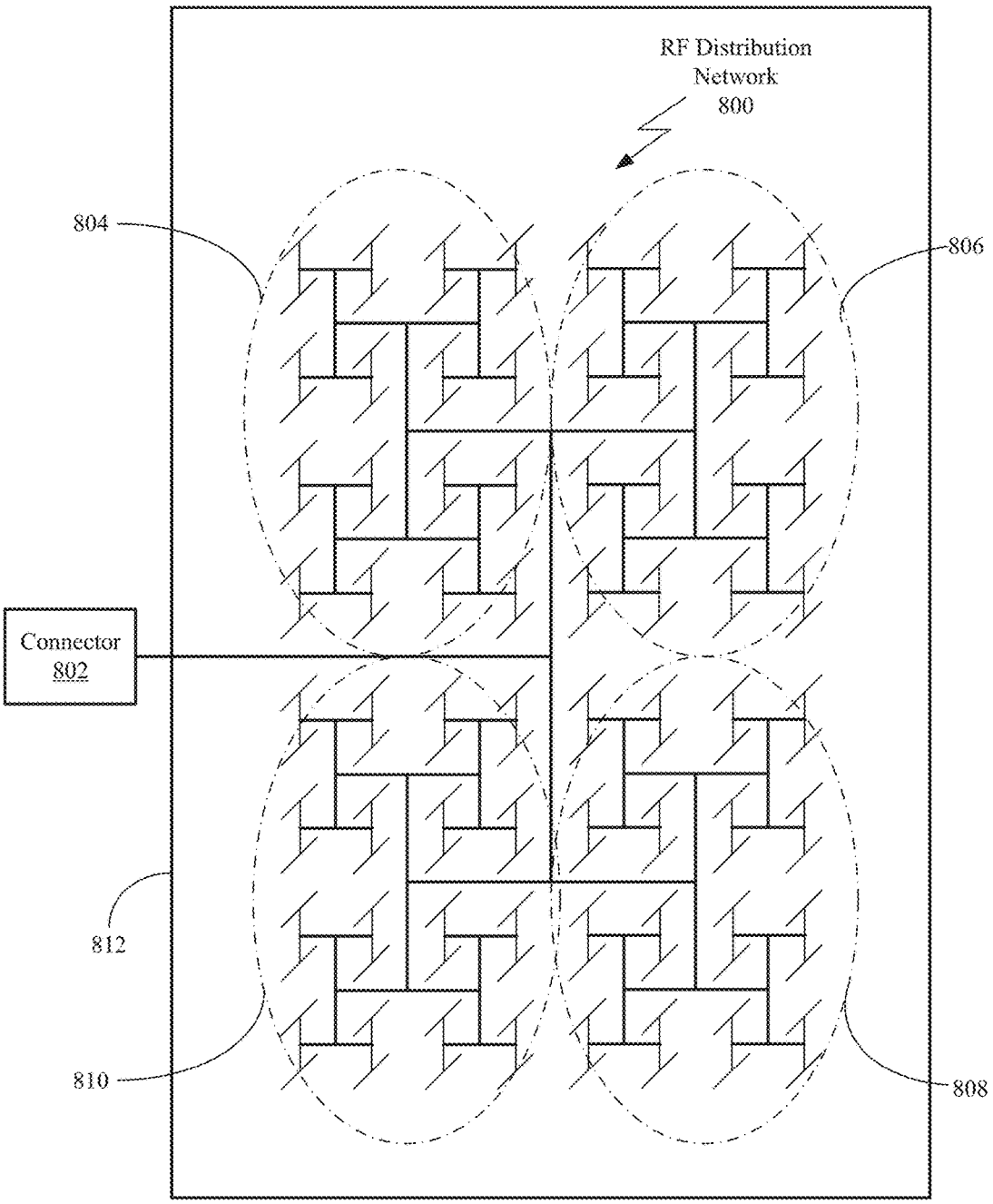
FIG. 8 is a top view of an example of an implementation of an RF distribution network, shown in FIGS. 4 and 5, in accordance with the present invention.

In FIG. 8, a top view of an example of an implementation of an RF distribution network 800 is shown in accordance with the present invention. The RF distribution network 800 is in signal communication with an RF connector 802 (which is an example of an RF connector such as the RF connectors 452, or 556 described earlier in FIGS. 4 and 5) and the plurality of T/R modules. In this example, the RF distribution network 800 is 16 by 16 distribution network that, in the transmit mode, is configured to divide an input signal from the RF connector 802 into 256 sub-signals that feed to the individual 256 T/R modules. In the receive mode, the RF distribution network 800 is configured to receive 256 individual signals from the 256 T/R modules and combine them into a combined output signal that is passed to the RF connector 802. In this example the RF distribution network may include eight stages 804, 806, 808, and 810 of two-way Wilkinson power combiners/dividers and the RF distribution network may be integrated into an internal layer of the MLPWB 812 or MLPWB's 206, 300, 400, 500 as described previously in FIGS. 4 and 5.

Figure 9:
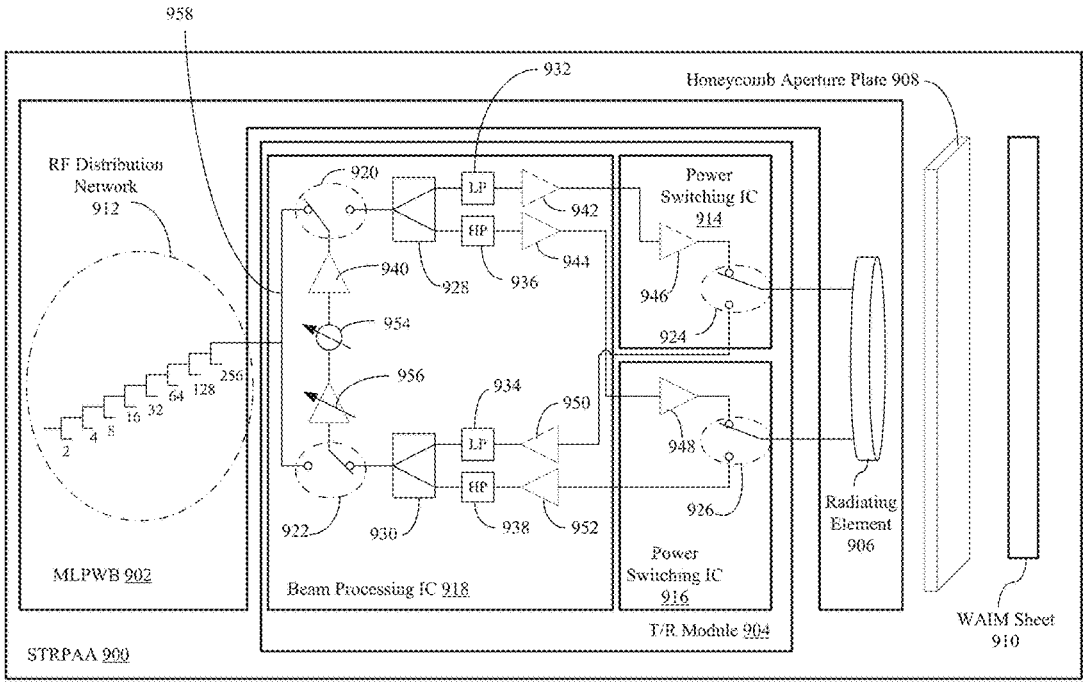
FIG. 9 is a system block diagram of an example of another implementation of the STRPAA in accordance with the present invention.

Turning to FIG. 9, a system Hock diagram of an example of another implementation of the STRPAA 900 is shown in accordance with the present invention. Similar to FIG. 2, in FIG. 9 the STRPAA 900 may include a MLPWB 902, T/R module 904, radiating element 906, honeycomb aperture plate 908, and WAIM sheet 910. In this example, the MLPWB 902 may include the RF distribution network 912 and the radiating element 906. The RF distribution network 912 may be a 256 element (i.e., 16 by 16) distribution network with eight stages of two-way Wilkinson power combiners/dividers.

The T/R module 904 may include two power switching integrated circuits ("ICs") 914 and 916 and a beam processing IC 918. The switching ICs 914 and 916 and beam processing IC 918 may be monolithic microwave integrated circuits ('MMICs") and they may be placed in signal communication with each other utilizing "flip-chip" packaging techniques.

It is appreciated by those of ordinary skill in the art that in general, flip-chip packaging techniques are a method for interconnecting semiconductor devices, such as integrated circuits "chips" and microelectromechanical systems ("MEMS") to external circuitry utilizing solder bumps or gold stud bumps that have been deposited onto the chip pads (i.e., chip contacts). In general, the bumps are deposited on the chip pads on the top side of a wafer during the final wafer processing step. In order to mount the chip to external circuitry (e.g., a circuit board or another chip or wafer), it is flipped over so that its top side faces down, and aligned so that its pads align with matching pads on the external circuit, and then either the solder is reflowed or the stud bump is thermally compressed to complete the interconnect. This is in contrast to wire bonding, in which the chip is mounted upright and wires are used to interconnect the chip pads to external circuitry.

In this example, the T/R module 904 may include circuitry that enables the T/R module 904 to have a switchable transmission signal path and reception signal path. The T/R module 904 may include a first, second, third, and fourth transmission path switches 920, 922, 924, and 926, a first and second 1:2 splitters 928 and 930, a first and second low pass filters ("LPFs") 932 and 934, a first and second high pass filters ("HPFs") 936 and 938, a first, second, third, fourth, fifth, sixth, and seventh amplifiers 940, 942, 944, 946, 948, 950, and 952, a phase-shifter 954, and attenuator 956.

In this example, the first and second transmission path switches 920 and 922 may be in signal communication with the RF distribution network 912, of the MLPWB 902, via signal path 958. Additionally, the third and fourth transmission path switches 924 and 926 may be in signal communication with the radiating element 906, of the MLPWB 902, via signal paths 960 and 962 respectively.

Furthermore, the third transmission path switch 924 and fourth amplifier 946 may be part of the first power switching MMIC 914 and the fourth transmission path switch 926 and fifth amplifier 948 may be part of the second power switching MMIC 916. Since the first and second power switching MMICs 914 and 916 are power providing ICs, they may be fabricated utilizing gallium-arsenide ("GaAs") technologies. The remaining first and second transmission path switches 920 and 922, first and second 1:2 splitters 928 and 930, first and second LPFs 932 and 934, first and second HPFs 936 and 938, first, second, third, sixth, and seventh amplifiers 940, 942, 944, 950, and 952, phase-shifter 954, and attenuator 956 may be part of the beam processing MMIC 918. The beam processing MMIC 918 may be fabricated utilizing silicon-germanium ("SiGe") technologies. In this example, the high frequency performance and the high density of the circuit functions of SiGe technology allows for a footprint of the circuit functions of the T/R module to be implemented in a phase array antenna that has a planar tile configuration (i.e., generally, the planar module circuit layout footprint is constrained by the radiator spacing due to the operating frequency and minimum antenna beam scan requirement).

Figure 10:
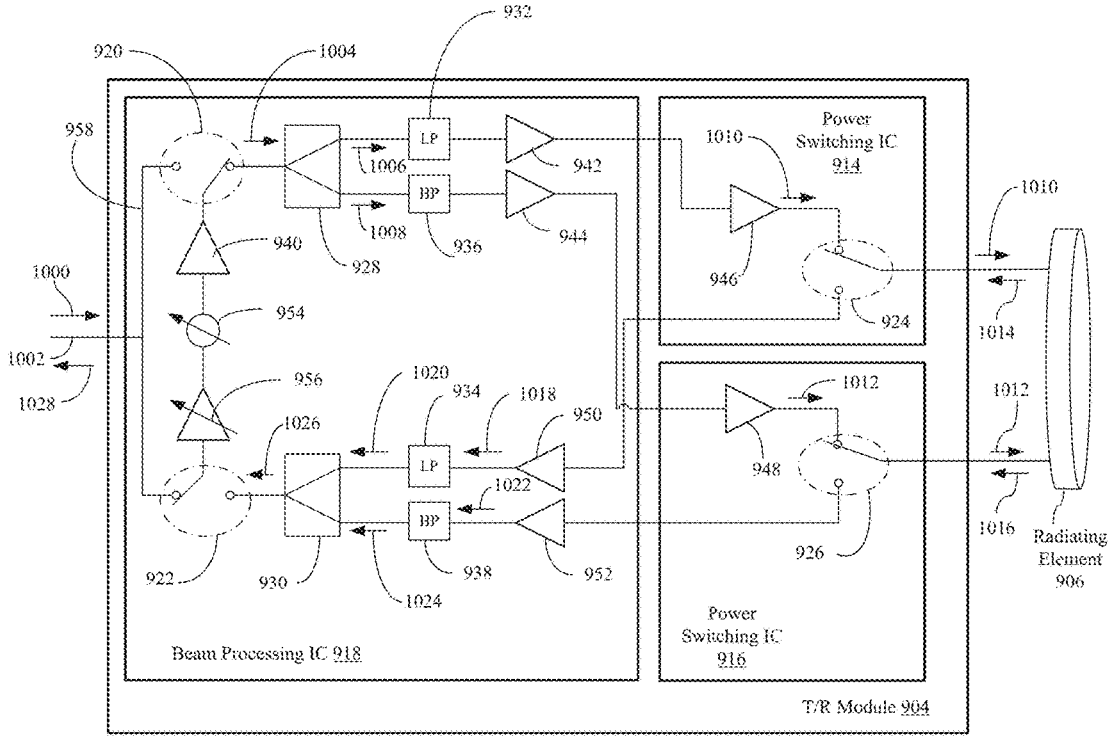
FIG. 10 is a system block diagram of the T/R module shown in FIG. 9.

In FIG. 10, a system block diagram of the T/R module 904 is shown to better understand an example of operation of the T/R module 904. In an example of operation, in transmission mode, the T/R module 904 receives an input signal 1000 from the RF distribution network 912 via signal path 1002. In the transmission mode, the first and second transmission path switches 920 and 922 are set to pass the input signal 1000 along the transmission path that includes passing the first transmission path switch 920, variable attenuator 956, phase-shifter 954, first amplifier 940, and second transmission path switch 922 to the first 1:2 splitter 928. The resulting processed input signal 1004 is then split into two signals 1006 and 1008 by the first 1:2 splitter 928. The first split input signal 1006 is passed through the first LPF 932 and amplified by both the second and fourth amplifiers 942 and 946. The resulting amplified first split input signal 1010 is passed through the third transmission path switch 924 to the first radiator (not shown) of the radiating element 906. In this example, the first radiator may be a radiator that is set to transmit a first polarization such as, for example, vertical polarization or right-handed circular polarization. Similarly, the second split input signal 1008 is passed through the first HPF 936 and amplified by both the third and fifth amplifiers 944 and 948. The resulting amplified second split input signal 1012 is passed through the fourth transmission path switch 926 to the second radiator (not shown) of the radiating element 906. In this example, the second radiator may be a radiator that is set to transmit a second polarization such as, for example, horizontal polarization or left-handed circular polarization.

In the receive (also known as reception) mode, the T/R module 904 receives a first polarization received signal 1014 from the first radiator in the radiating element 906 and a second polarization received signal 1016 from the second radiator in the radiating element 906.

In the receive mode, the first, second, third, and fourth transmission path switches 920, 922, 924, and 926 are set to pass the first polarization received signal 1014 and second polarization received signal 1016 to the RF distribution network 912 through the variable attenuator 956, phase-shifter 954, and first amplifier 940. Specifically, the first polarization received signal 1014 is passed through the third transmission path switch 924 to the sixth amplifier 950. The resulting amplified first polarization received signal 1018 is then passed through the second LPF 934 to the second 1:2 splitter 930 resulting in a filtered first polarization received signal 1020.

Similarly, the second polarization received signal 1016 is passed through the fourth transmission path switch 926 to the seventh amplifier 952. The resulting amplified second polarization received signal 1022 is then passed through the second LPF 934 to the second 1:2 splitter 930 resulting in a filtered second polarization received signal 1024. The second 1:2 splitter 930 then acts as a 2:1 combiner and combines the filtered first polarization received signal 1020 and filtered second polarization received signal 1024 to produce a combined received signal 1026 that is passed through the second transmission path switch 922, variable attenuator 956, phase-shifter 954, first amplifier 940, and the first transmission path switch 920 to produce a combined received signal 1028 that is passed to the RF distribution network 912 via signal path 1002.

Figure 11:
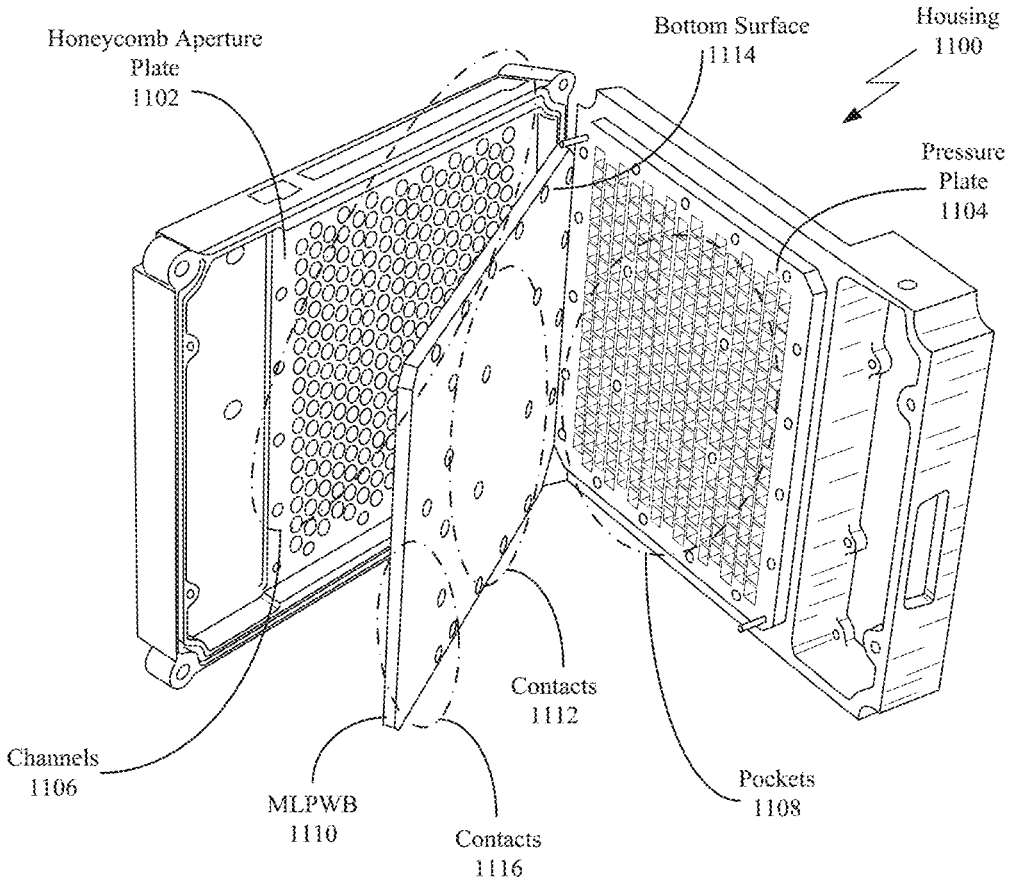
FIG. 11 is a prospective view of an open example of an implementation of the housing, shown in FIG. 2, in accordance with the present invention.

Turning to FIG. 11, a prospective view of an open example of an implementation of the housing 1100 is shown in accordance with the present invention. In this example, the housing 1100 includes the honeycomb aperture plate 1102 and pressure plate 1104. The honeycomb aperture plate 1102 is shown to have a plurality of channels 1106 that pass through honeycomb aperture plate 1102. Additionally, the pressure plate 1104 includes a plurality of pockets 1108 to receive the plurality of T/R modules (not shown). In this example, the MLPWB 1110 is shown in a configuration that fits inside the housing 1100 between the honeycomb aperture plate 1102 and pressure plate 1104. The MLPWB 1110 is also shown to have a plurality of contacts 1112 along the bottom surface 1114 of the MLPWB 1110. The plurality of contacts 1112 are configured to electrically interface with the plurality of T/R modules (not shown) once placed in the housing 1100. Additional contacts 1116 are also shown for interfacing the RF distribution network (not shown and within the layers of the MLPWB 1110) with an RF connector (not shown but described in FIGS. 4 and 5) and other electrical connections (such as, for example, biasing, grounding, power supply, etc.).

Figure 12:
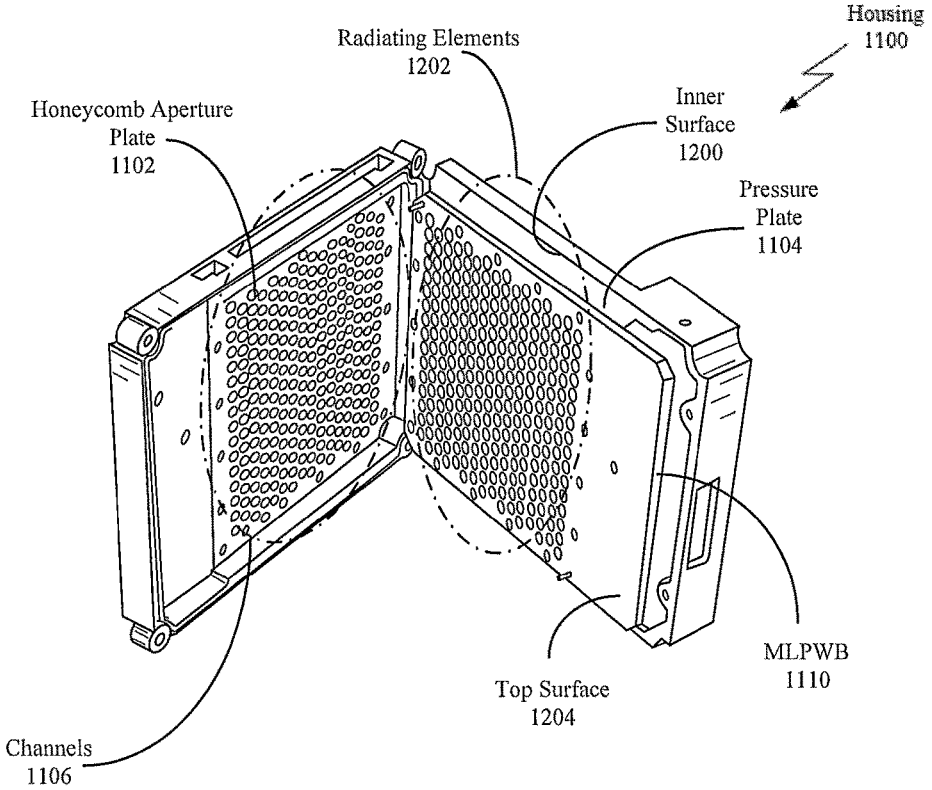
FIG. 12 is another prospective view of the open housing shown in FIG. 12.
Figure 13:
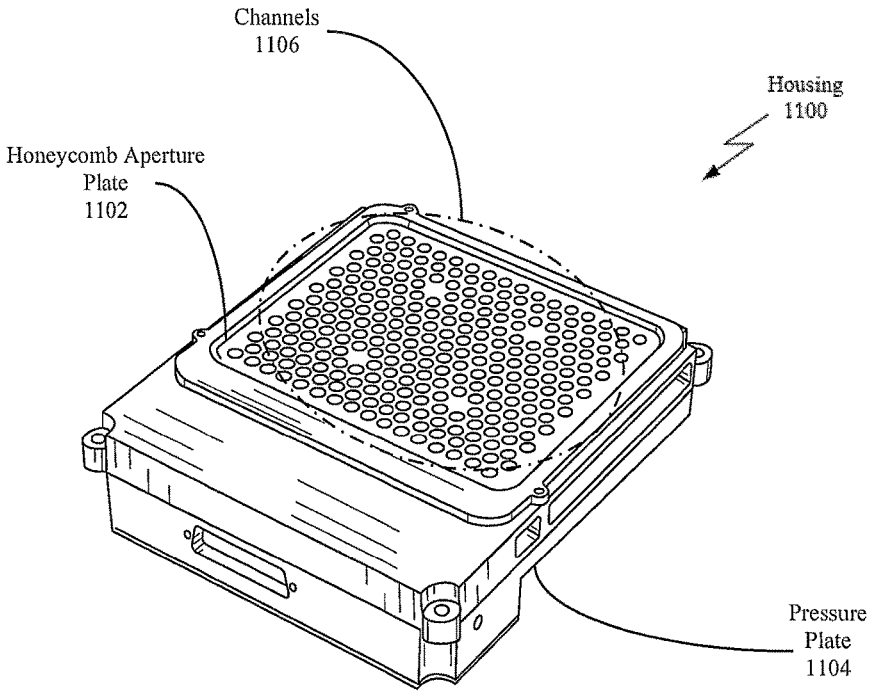
FIG. 13 is a prospective top view of the closed housing, shown in FIGS. 11 and 12, without a WAIM sheet installed on top of the honeycomb aperture plate in accordance with the present invention.
Figure 14:
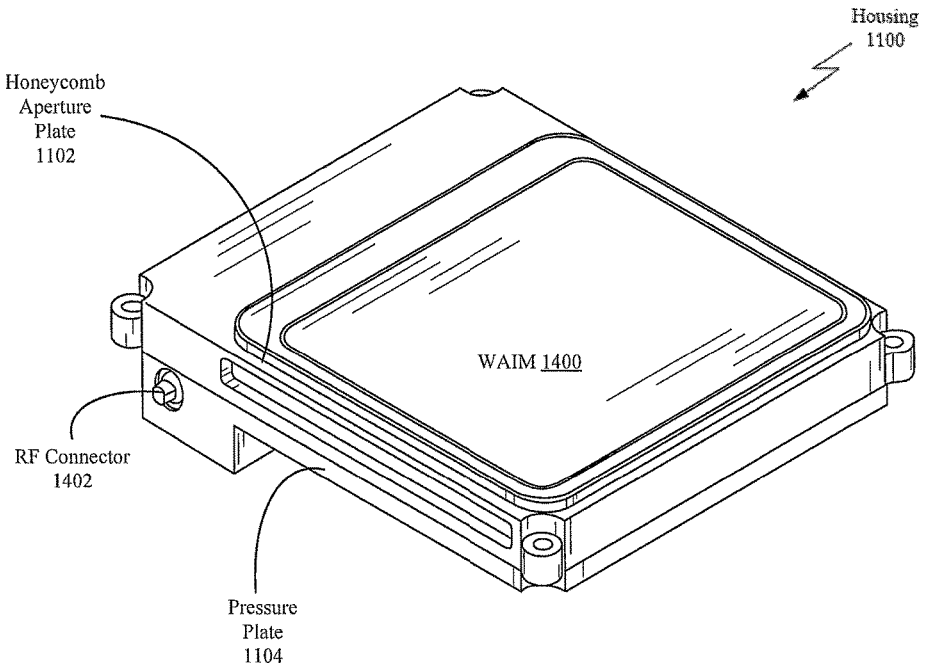
FIG. 14 is a prospective top view of the closed housing, shown in FIGS. 11, 12, and 13, with a WAIM sheet installed on top of the honeycomb aperture plate in accordance with the present invention.

In FIG. 12, another prospective view of the open housing 1100, described in FIG. 12, is shown. In this example, the MLPWB 1110 is shown placed against the inner surface 1200 of the pressure plate 1104. In the view, a plurality of radiating elements 1202 are shown formed in the top surface 1204 of the MLPWB 1110. In FIG. 13, a prospective top view of the closed housing 1100 is shown without a WAIM sheet installed on top of the honeycomb aperture plate 1102. The honeycomb aperture plate 1102 is shown including a plurality of channels 1106. Turning to FIG. 14, a prospective top view of the closed housing 1100 is shown with a WAIM sheet 1400 installed on top of the honeycomb aperture plate 1102. The bottom of the housing 1100 is also shown to have an example RF connector 1402.

Figure 15:
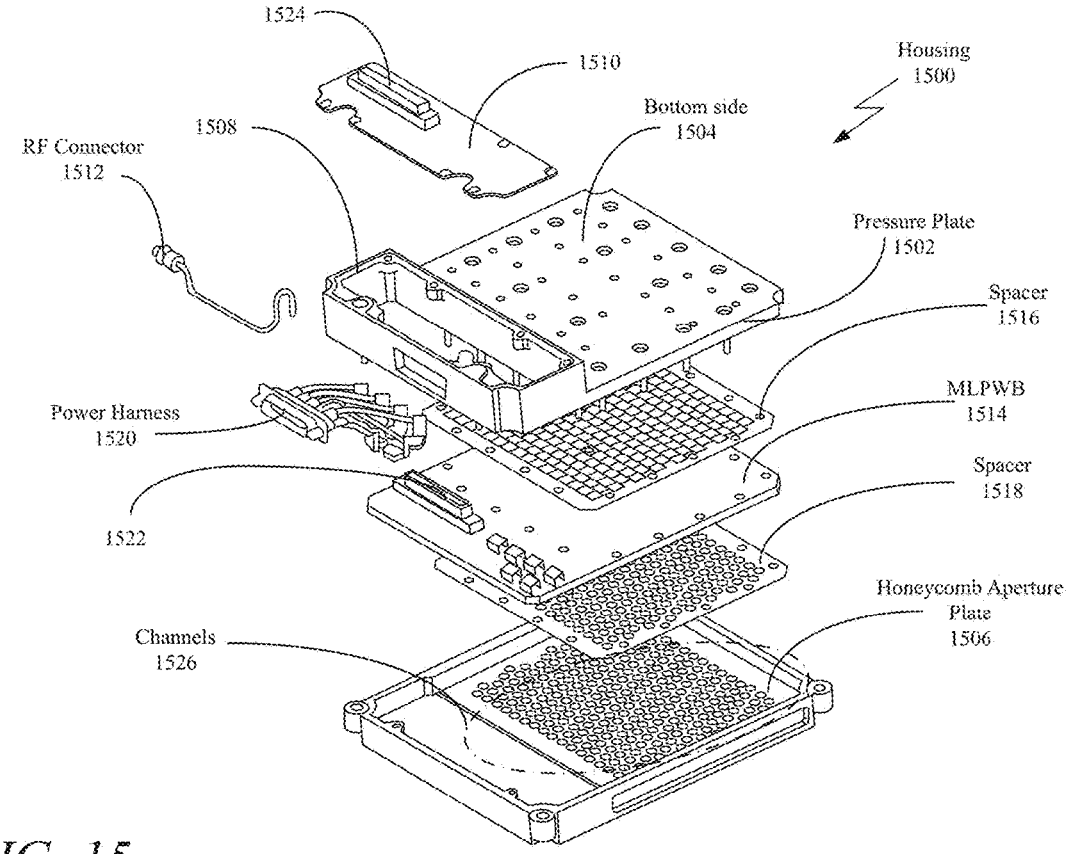
FIG. 15 is an exploded bottom prospective view of an example of an implementation of the housing, shown in FIGS. 11, 12, 13, and 14, in accordance with the present invention.

Turning to FIG. 15, an exploded bottom prospective view of an example of an implementation of the housing 1500 is shown in accordance with the present invention. In this example, the housing 1500 includes pressure plate 1502 having a bottom side 1504, honeycomb aperture plate 1506, a wiring space 1508, wiring space cover 1510, and RF connector 1512. Inside the housing 1500 is the MLPWB 1514, a first spacer 1516, second spacer 1518, and power harness 1520. The power harness 1520 provides power to the STRPAA and may include a bus type signal path that may be in signal communication with the power supply 108, controller 104, and temperature control system 106 shown in FIG. 1. The power harness 1520 is located within the wiring space 1508 and may be in signal communication with the MLPWB 1514 via a MLPWB interface connector, or connectors, 1522 and with the power supply 108, controller 104, and temperature control system 106, of FIG. 1, via a housing connector 1524. Again, the honeycomb aperture plate 1506 includes a plurality of channels 1526.

In this example, the spacers 1516 and 158 are conductive sheets (i.e., such as metal) with patterned bumps to provide grounding connections between the MLPWB 1514 ground planes and the adjacent metal plates (i.e., pressure plate 1502 and honeycomb aperture plate 1506, respectively). Specifically, spacer 1516 maintains an RF ground between the MLPWB 1514 and the Pressure Plate 1502. Spacer 1518 maintains an RF ground between the MLPWB 1514 and the Honeycomb Aperture Plate 1506. The shape and cutout pattern of the spacers 1516 and 1518 also maintains RF isolation between the individual array elements to prevent performance degradation that might occur without this RF grounding and isolation. In general, the spacers 1516 and 1518 maintain the grounding and isolation by absorbing any flatness irregularities present between the chassis components (for example pressure plate 1502 and honeycomb aperture plate 1506) and the MLPWB 1514. This capability may be further enhanced by utilizing micro bumps in the surface of a plurality of shims (i.e., the spacers 1516 and 1518) that can collapse by varying degrees when compressed to absorb flatness irregularities.

Figure 16:
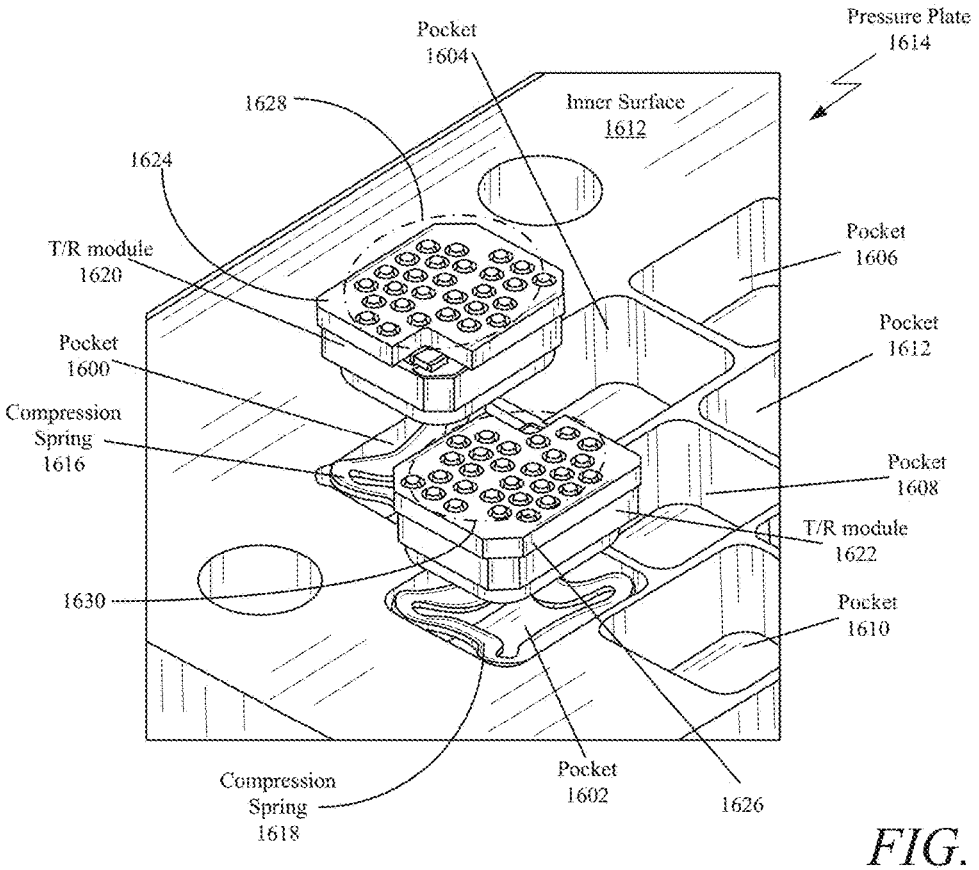
FIG. 16 is a top view of an example of an implementation of the pockets, shown in FIG. 11, along the inner surface of the pressure plate in accordance with the present invention.

In FIG. 16, a top view of an example of an implementation of the pockets 1600, 1602, 1604, 1604, 1606, 1608, and 1610 (described as pockets 1108 in FIG. 11) along the inner surface 1612 of the pressure plate 1614 is shown in accordance with the present invention. In this example, the first and second pockets 1600 and 1602 include a first and second compression spring 1616 and 1618, respectively. Into the first and second pockets 1600 and 1602 and against the first and second compression spring 1616 and 1618 are placed against first and second T/R modules 1620 and 1622, respectively. In this example, the compression springs in the pockets provide a compression force against the bottom of the T/R modules to push them against the bottom surface of the MLPWB. Similar to the examples described in FIGS. 4 and 5, each T/R module 1620 and 1622 includes a holder 1624 and 1626, respectively, which includes a plurality of electrical interconnect signal contacts 1628 and 1630, respectively.

Figure 17:
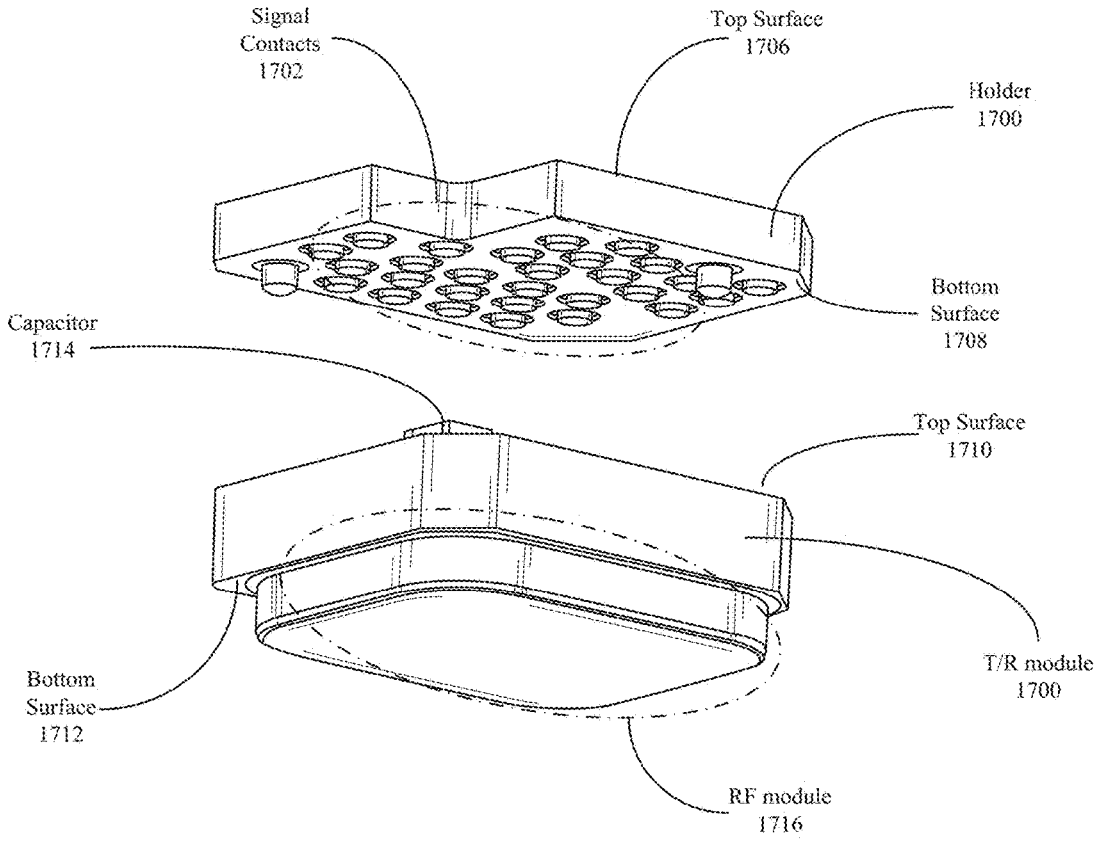
FIG. 17 is an exploded perspective side-view of an example of an implementation of a T/R module, shown in FIGS. 2, 4, 5, 9, 10, and 16, in combination with a plurality of PCB (board-to-board) electrical interconnects in accordance with the present invention.

Turning to FIG. 17, an exploded perspective side-view of an example of an implementation of a T/R module 1700 in combination with a plurality of electrical interconnect signal contacts 1702 is shown in accordance with the present invention. The electrical interconnect signal contacts 1702 (in this example shown as fuzz Buttons®) are located within a holder 1704 that has a top surface 1706 and bottom surface 1708. The T/R module 1700 includes a top surface 1710 and bottom surface 1712 where they may be a capacitor 1714 located on the top surface 1710 and an RF module 1716 located on the bottom surface 1710. In an alternate implementation, there would be no holder 1700, and the electrical interconnect signal contacts 1702 may be a plurality of solder balls, i.e., ball grid.

Figure 18:
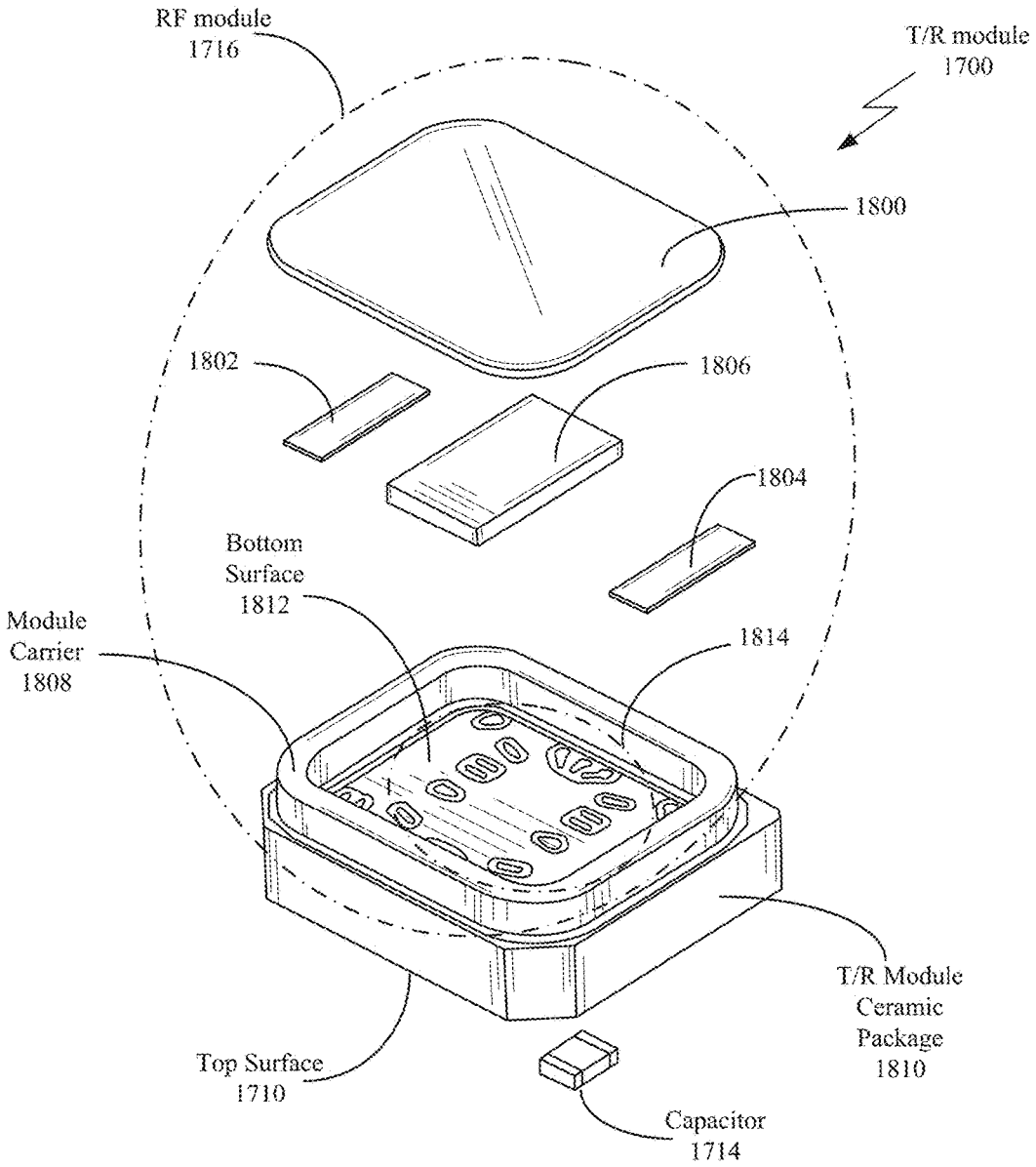
FIG. 18 is an exploded perspective top view of the T/R module shown in FIG. 17.

In FIG. 18, an exploded perspective top view of the planar circuit T/R module 1700 (herein generally referred to as the T/R module) is shown in accordance with the present invention. Specifically, the RF module 1716 is exploded to show that the RF module 1716 includes a RF module lid 1800, first power switching MMIC 1802, second power switching MMIC 1804, beam processing MMIC 1806, module carrier 1808, and T/R module ceramic package 1810. In this example, the T/R module ceramic package 1810 has a bottom surface 1812 and a top surface that corresponds to the top surface 1710 of the T/R module 1700. The bottom surface 1812 of the T/R module ceramic package 1810 includes a plurality of T/R module contacts 1814 that form signal paths so as to allow the first power switching MMIC 1802, second power switching MMIC 1804, and beam processing MMIC 1806 to be in signal communication with the T/R module ceramic package 1810. In this example, the first power switching MMIC 1802, second power switching MMIC 1804, and the beam processing MMIC 1806 are placed within the module carrier 1808 and covered by the RF module lid 1800. In this example, the first power switching MMIC 1802, second power switching MMIC 1804, beam processing MMIC 1806 may be placed in the module carrier 1808 in a flip-chip configuration where the first power switching MMIC 1802 and second power switching MMIC 1804 may be oriented with their chip contacts directed away from the bottom surface 1812 and the beam processing MMIC 1806 may be in the opposite direction of the first power switching MMIC 1802 and second power switching MMIC 1804.

It is appreciated by those of ordinary skill in the art that similar to the MLPWB for the housing of the STRPAA, the T/R module ceramic package 1810 may include multiple layers of substrate and metal forming microcircuits that allow signals to pass from the T/R module contacts 1814 to T/R module top surface contacts (not shown) on the top surface 1710 of the T/R module 1700. As an example, the T/R module ceramic package 1810 may include ten (10) layers of ceramic substrate and eleven (11) layers of metallic material (such as, for example, aluminum nitride ("AlN") substrate with gold metallization) with substrate thickness of approximately 0.005 inches with multiple vias.

Figure 19:
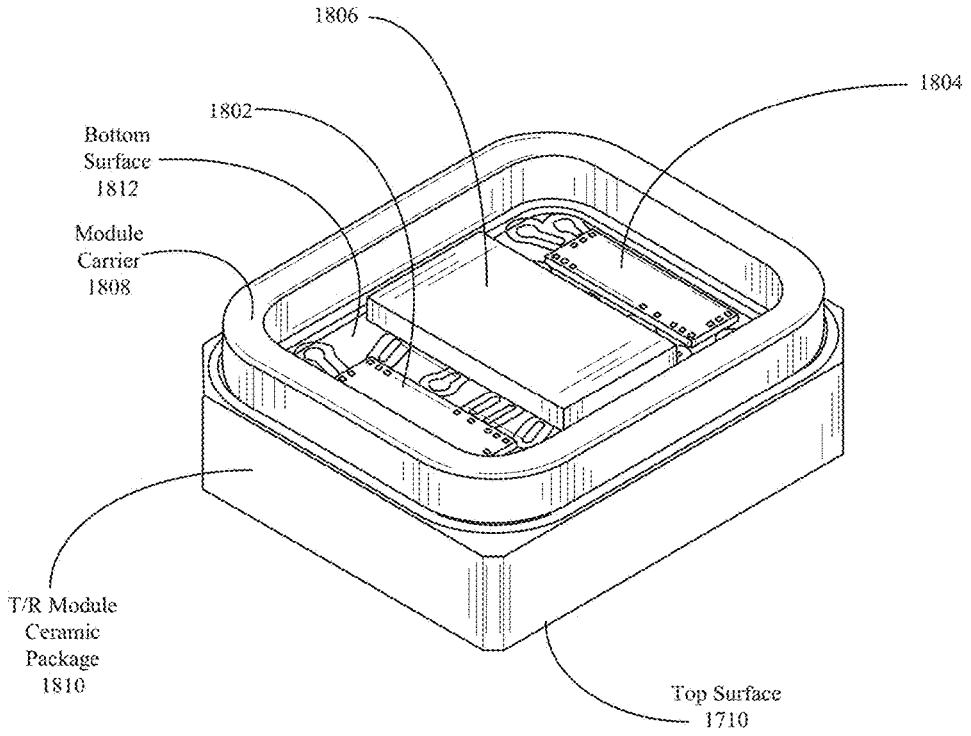
FIG. 19 is a perspective top view of the T/R module with the first power switching MMIC, second power switching MMIC, and beam processing MMIC installed in the module carrier, shown in FIG. 18, in accordance with the present invention.

In FIG. 19, a perspective top view of the T/R module 1700 (in a title configuration) with the first power switching MMIC 1802, second power switching MMIC 1804, and beam processing MMIC 1806 installed in the module carrier 1808 is shown in accordance with the present invention.

Figure 20:
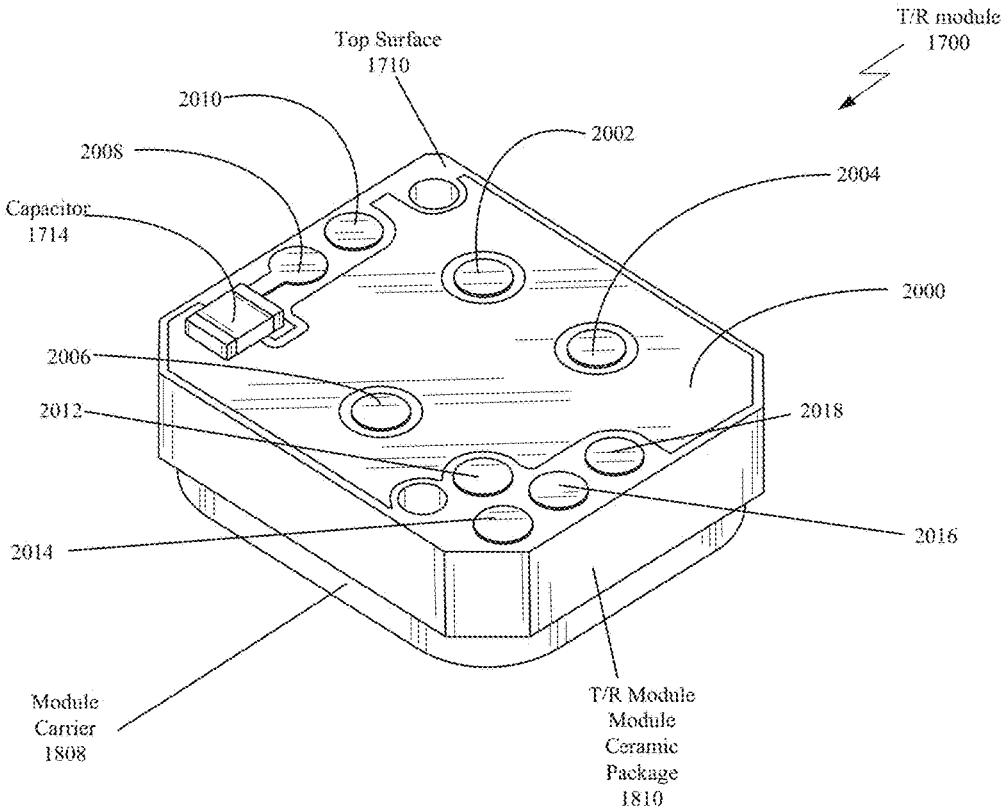
FIG. 20 is a perspective bottom view of the T/R module, shown in FIGS. 17, 18, and 19, in accordance with the present invention.

Turning to FIG. 20, a perspective bottom view of the T/R module 1700 is shown in accordance with the present invention. In this example, the top surface 1710 of the T/R module 1700 may include multiple conductive metallic pads 2000, 2002, 2004, 2004, 2006, 2008, 2010, 2012, 2014, and 2016 that are in signal communication with the electrical interconnect signal contacts. In this example, the first conductive metallic pad 2000 may be a common ground plane. The second conductive metallic pad 2002 may produce a first RF signal that is input to the first probe of the first radiator (not shown) on the corresponding radiating element to the T/R module 1700. In this example, the signal output from the T/R module 1700 through the second conductive metallic pad 2002 may be utilized by the corresponding radiating element to produce radiation with a first polarization. Similarly, third conductive metallic pad 2004 may produce a second RF signal that is input to the second probe of the second radiator (not shown) on the corresponding radiating element. The signal output from the T/R module 1700 through the third conductive metallic pad 2004 may be utilized by the corresponding radiating element to produce radiation with a second polarization that is orthogonal to the first polarization.

The fourth conductive metallic pad 2006 may be an RF communication port. The fourth conductive metallic pad 2006 may be an RF common port, which is the input RF port for the T/R module 1700 module in the transmit mode and the output RF port for the T/R module 1700 in the receive mode. Turning back to FIG. 9, the fourth conductive metallic pad 2006 is in signal communication with the RF distribution network 912. The fifth conductive metallic pad 2008 may be a port that produces a direct current ("DC") signal (such as, for example, a +5-volt signal) that sets the first conductive metallic pad 2008 to a ground value that may be equal to 0 volts or another reference DC voltage level such as, for example, the +5 volts supplied by the fifth conductive metallic pad 2008. The capacitor 1714 provides stability to the MMICs (i.e., MMICs 1802 and 1804) in signal communication to the fifth conductive metallic pad 2008.

Additionally, in this example, port 2008 provides +5V biasing voltage for the GaAs power amplifier in the power switching MMICs 1802 and 1804, ports 2010 and 2016 provide −5V basing voltage for the SiGe beam processing MMIC 1806, and the GaAs power switching MMIC 1802 and 1804. Port 2012 provides a digital data signal and port 2018 provides the digital clock signal, both these signals are for phase shifters in SiGe beam processing MMIC 1806 and form part of the array beam steering control. Moreover, port 2014 provides +3.3V biasing voltage for the SiGe MMIC 1806.

In this example, the T/R module ceramic package 1810 may include multiple layers of substrate and metal forming microcircuits that allow signals to pass from the T/R module contacts 1814 to T/R module top surface contacts (not shown) on the top surface 1710 of the T/R module 1700.

Figure 21:
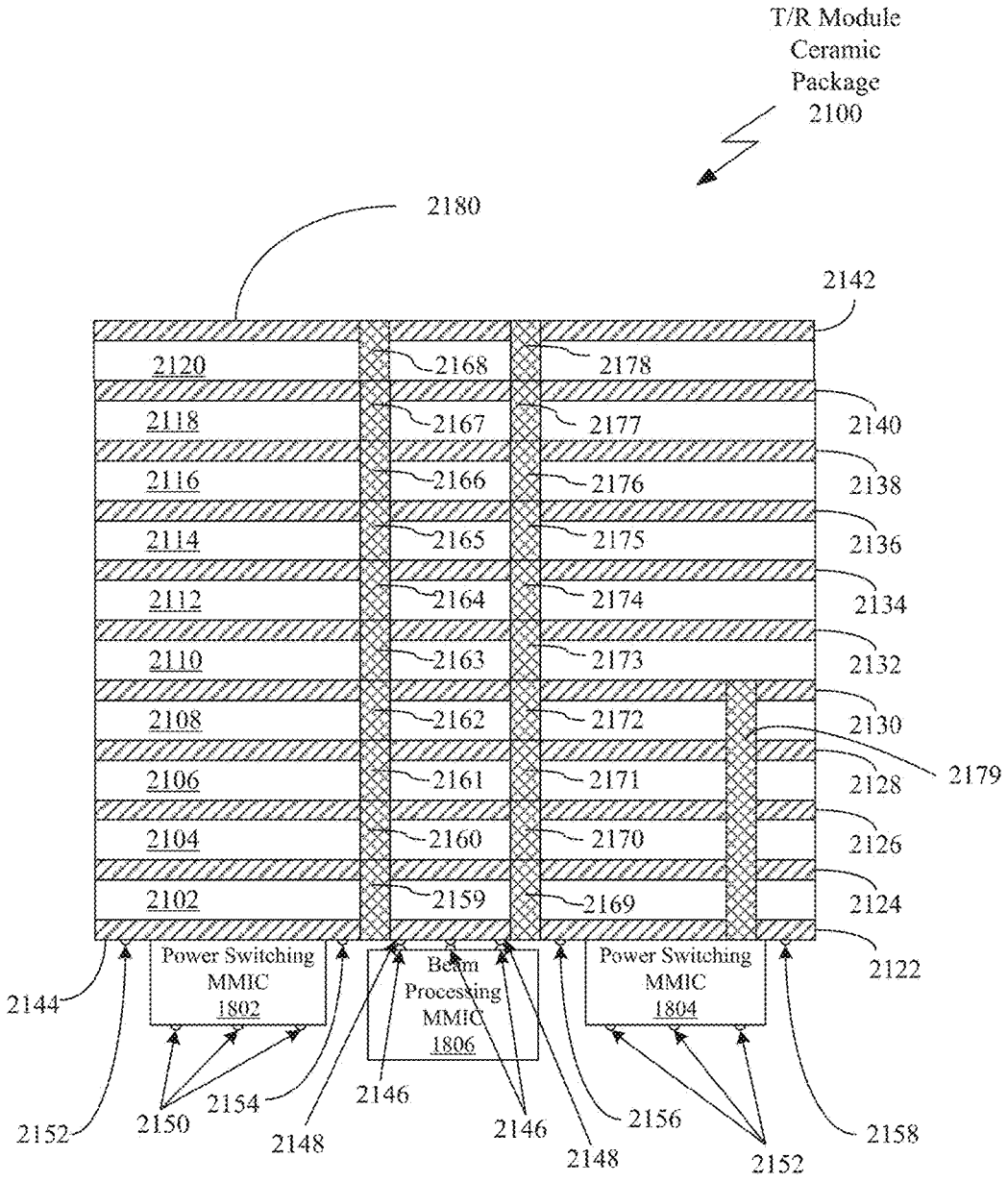
FIG. 21 is a partial cross-sectional view of an example of an implementation of a transmit and receive module ceramic package ("T/R module ceramic package") in accordance with the present invention.

Turning to FIG. 21 and similar to FIG. 3, a partial cross-sectional view of an example of an implementation of the T/R module ceramic package 2100 (also known as the T/R module ceramic package 2100) is shown in accordance with the present invention. In this example, the T/R module ceramic package 2100 may include ten (10) substrate layers 2102, 2104, 2106, 2108, 2110, 2112, 2114, 2116, 2118, and 2120 and eleven (11) metallic layers 2122, 2124, 2126, 2128, 2130, 2132, 2134, 2136, 2138, 2140, and 2142. In this example, the beam processing MMIC 1806 and power switching MMICs 1802 and 1804 are located at the bottom surface 2144 of the T/R module ceramic package 2100 in a flip-chip configuration. In this example, the beam processing MMIC 1806 is shown having solder bumps 2146 protruding from the bottom of the beam processing MMIC 1806 in the direction of the bottom surface 2144 of the T/R module ceramic package 2100. The beam processing MMIC 1806 solder bumps 2146 are in signal communication with the solder bumps 2146 of the T/R module ceramic package 2100 that protrude from the bottom surface 2144 of the T/R module ceramic package 2100 in the direction of the beam processing MMIC 1806. Similarly, the power switching MMICs 1802 and 1804 also have solder bumps 2150 and 2152, respectively, which are in signal communication with the solder bumps 2152, 2154, 2156, and 2158, respectively, of the bottom surface 2144 of the T/R module ceramic package 2100. Similar to the MLPWB 300, shown in FIG. 3, the T/R module ceramic package 2100 may include a plurality of vias 2159, 2160, 2161, 2162, 2163, 2164, 2165, 2166, 2167, 2168, 2169, 2170, 2171, 2172, 2173, 2174, 2175, 2176, 2177, 2178, and 2179. In this example, the via 2179 may be a blind hole that goes from the bottom surface 2144 to an internal substrate layer 2104, 2106, 2108, 2110, 2112, 2114, 2116, and 2118 in between the bottom surface 2144 and top surface 2180 of the T/R module ceramic package 2100. It is appreciated by those of ordinary skill in the art that similar to substrate layers shown in FIG. 3, each individual substrate layer 2102, 2104, 2106, 2108, 2110, 2112, 2114, 2116, 2118, and 2120 may include etched circuitry within each substrate layer.

Figure 22:
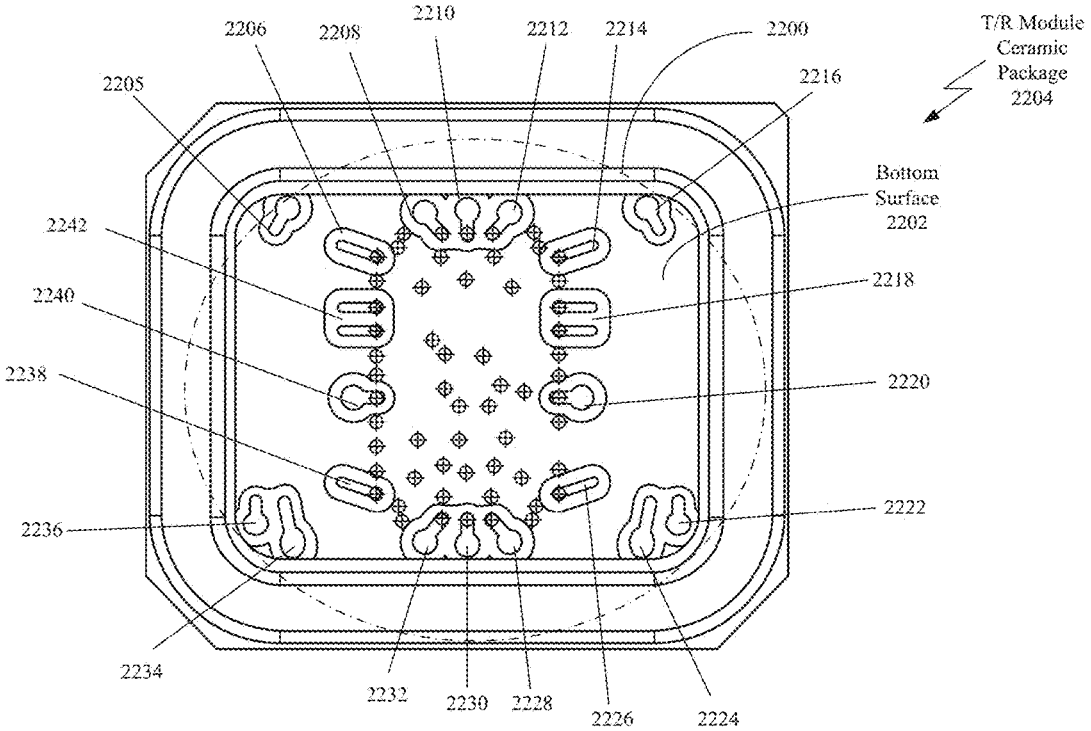
FIG. 22 is a diagram of an example of an implementation of a printed wiring assembly on the bottom surface of the T/R module ceramic package 2204 in accordance with the present invention.

In FIG. 22, a diagram of an example of an implementation of a printed wiring assembly 2200 on the bottom surface 2202 of the T/R module ceramic package 2204. The printed wiring assembly 2200 includes a plurality of electrical pads with solder or gold stud bumps 2205, 2206, 2208, 2210, 2212, 2214, 2216, 2218, 2220, 2222, 2224, 2226, 2228, 2230, 2232, 2234, 2236, 2238, 2240, and 2242 that will be bonded to the solder bumps or stud bumps (shown in FIG. 21) of the beam processing MMIC 1806 and power switching MMICs 1802 and 1804.

Figure 23:
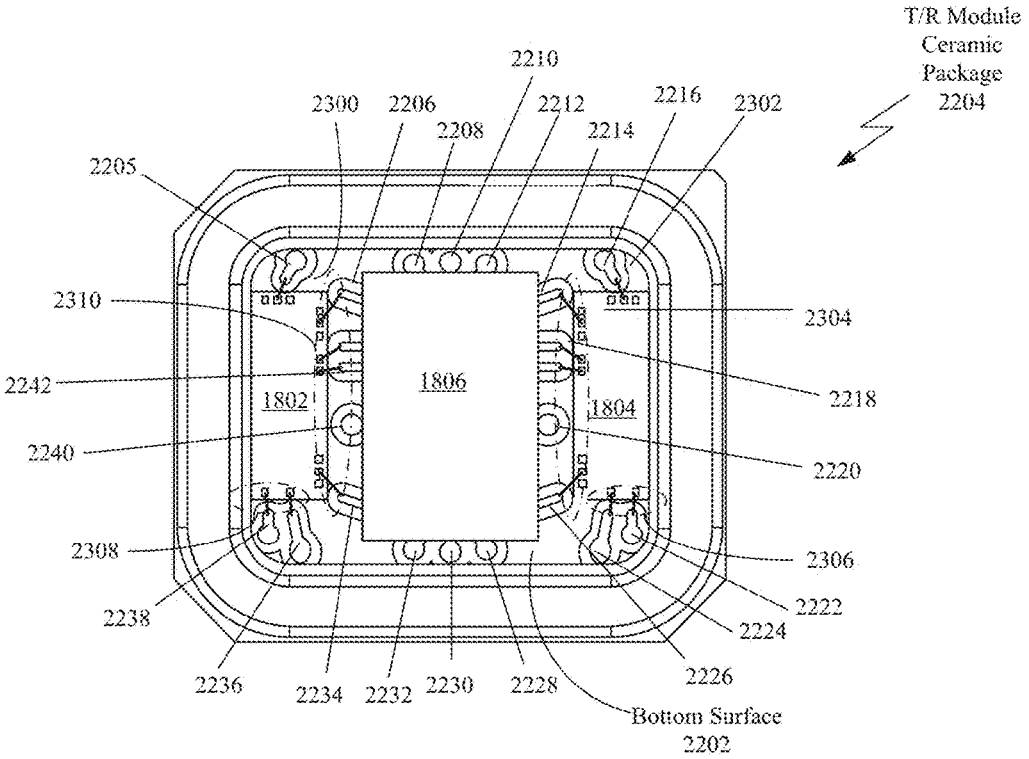
FIG. 23 is a diagram illustrating an example of an implementation of the mounting of the beam processing MMIC and power switching MMICs on the printed wiring assembly, shown in FIG. 22, in accordance with the present invention.

Turning to FIG. 23, a diagram illustrating an example of an implementation of the mounting of the beam processing MMIC 1806 and power switching MMICs 1802 and 1804 on the printed wiring assembly 2200, shown in FIG. 22, in accordance with the present invention. In this example, the layout is a title configuration. Additionally, in this example, wire bonds connections 2300, 2302, 2304, 2306, 2308, and 2310 are shown between the beam processing MMIC 1806 and power switching MMICs 1802 and 1804 and the printed wiring assembly 2200 electrical pads 2205, 2206, 2208, 2210, 2212, 2214, 2216, 2218, 2220, 2222, 2224, 2226, 2228, 2230, 2232, 2234, 2236, 2238, 2240, and 2242. Specifically, the first power switching MMIC 1802 is shown in signal communication with the electrical pads 2205, 2206, 2234, 2236, 2238, and 2242 via wire bonds 2300, 2310, and

2308, respectively. Similarly, the second power switching MMIC 1804 is shown in signal communication with the electrical pads 2214, 2216, 2218, 2222, 2224, and 2226 via wire bonds 2302, 2304, and 2306, respectively. The beam processing MMIC 1806 is shown in signal communication with electrical pads 2206, 2209, 2210, 2212, 2214, 2218, 2220, 2226, 2228, 2230, 2232, 2234, 2240, and 2242 via solder bumps (shown in FIG. 21).

It is appreciated by those of ordinary skill in the art that the STRPAA has been described as having a fixed plurality of radiating elements that may be either separate modules, devices, and/or components that are attached to the top surface 226 of the MLPWB 206 or they may actually be part of the MLPWB 206 as etched elements on the surface of the top surface 226 of the MLPWB 206 (such as, for example, a microstrip/patch antenna element) as was described in FIG. 6. In either case, unless the plurality of T/R modules, MLPWB, and plurality of radiating elements have been designed to operate with at least dual elliptical polarizations, the STRPAA is generally a system that operates with a fixed elliptical polarization since the STRPAA is a two-dimensional antenna array. For simplicity, in this disclosure it will be assumed that the STRPAA will operate with circular polarization which is a simplified case of elliptical polarization. However, it is appreciated that while circular polarization is described in this disclosure, the disclosure fully supports the utilization of non-circular elliptically polarization.

In this example, a first and second elliptical polarizations will be described as either "right-hand" circular polarization ("RHCP") or "left-hand" circular polarization ("LHCP") since these are the two types of polarization available for circular polarized signals. In this disclosure, the terms left-hand and right-hand are designated based on utilizing the "thumb in the direction of the propagation" rule that is well known to those of ordinary skill in the art.

An advantage of the design of the STRPAA is that it allows the STRPAA to be fabricated to operate in either fixed RHCP or fixed LHCP utilizing the same common radiating elements and T/R modules. The only needed change in the fabrication process is to change the type of MLPWB that is utilized, the azimuth orientation of the radiating elements, and possibly the housing. This is an important advantage because it eliminates the cost of redesigning the T/R modules and fabricating another set of modified T/R modules for the fabrication process. Additionally, another advantage is that if the STRPAA has already been produced and is operating in the field, this disclosure describes a relatively simple modification process that may be performed in the field that allows the existing STRPAA to be converted from operating in one elliptical polarization to another elliptical polarization. In this example modification process, the STRPAA will utilize the same common radiating elements and T/R modules and again the only needed change in the process is to change the type of MLPWB that is utilized, the azimuth orientation of the radiating elements, and possibly the housing. In this example modification process, the first MLPWB utilized by the STRPAA (that operates a first type of elliptical polarization) may be removed from the STRPAA and replaced with a new MLPWB that is configured to operate with a second type of elliptical polarization. In general, this means that the fabrication process allows the fabrication of STRPAAs that are configured to operate in either fixed RHCP or fixed LHCP. Moreover, the conversion process allows a STRPAA in the field that was fabricated to operate with either fixed RHCP or fixed LHCP may be modified in the field (or sent back to be quickly modified away from the field) to operate in the opposite polarization (i.e., RHCP to LHCP or LHCP to RHCP).

For the purpose of describing how the STRPAA may be either configured in fabrication with one of two types of elliptical polarizations or converted from a first type of elliptical polarization to another type of elliptical polarization, the STRPAA (as describe earlier) may generally be described as including the housing, a plurality of radiating elements, and a plurality of T/R modules. However, unlike the previous examples, in this example, the STRPAA may also include either a first MLPWB configured to produce a first elliptical polarization or a second MLPWB configured to produce a second elliptical polarization within the housing. As before, the first MLPWB includes a first MLPWB top surface and a first MLPWB bottom surface and the second MLPWB also includes a second MLPWB top surface and a second MLPWB bottom surface.

The plurality of radiating elements may be attached to either the first MLPWB top surface or the second MLPWB top surface. If attached to the first MLPWB top surface, the plurality of radiating elements are attached to the first MLPWB top surface at a predetermined azimuth position while, if attached to the second MLPWB top surface, the plurality of radiating elements are attached to the second MLPWB top surface at approximately 180 degrees in azimuth from the predetermined azimuth position. In other words, the predetermined azimuth position is the position that the radiators are oriented within the honeycomb aperture plate and/or on the top surface of the MLPWB that is determined by the design parameters of the STRPAA utilizing the first MLPWB. In relation to this orientation (i.e., the predetermined azimuth position), the radiators attached to the second MLPWB will be oriented in a "mirrored" position which corresponds to rotating each individual radiator by approximately 180 degrees from the orientation of the radiators attached to the first MLPWB.

Also as described earlier, the plurality of T/R modules may be attached to either the first MLPWB bottom surface or the second MLPWB bottom surface, where the plurality of T/R modules are in signal communication with either the first MLPWB bottom surface or the second MLPWB bottom surface. Each T/R module of the plurality of T/R modules may be located on either the first MLPWB bottom surface opposite a corresponding radiating element of the plurality of radiating elements attached to the first MLPWB top surface or the second MLPWB bottom surface opposite the corresponding radiating element of the plurality of radiating elements attached to the second MLPWB top surface, where each T/R module is in signal communication with the corresponding radiating element located opposite the T/R module.

Figure 24:
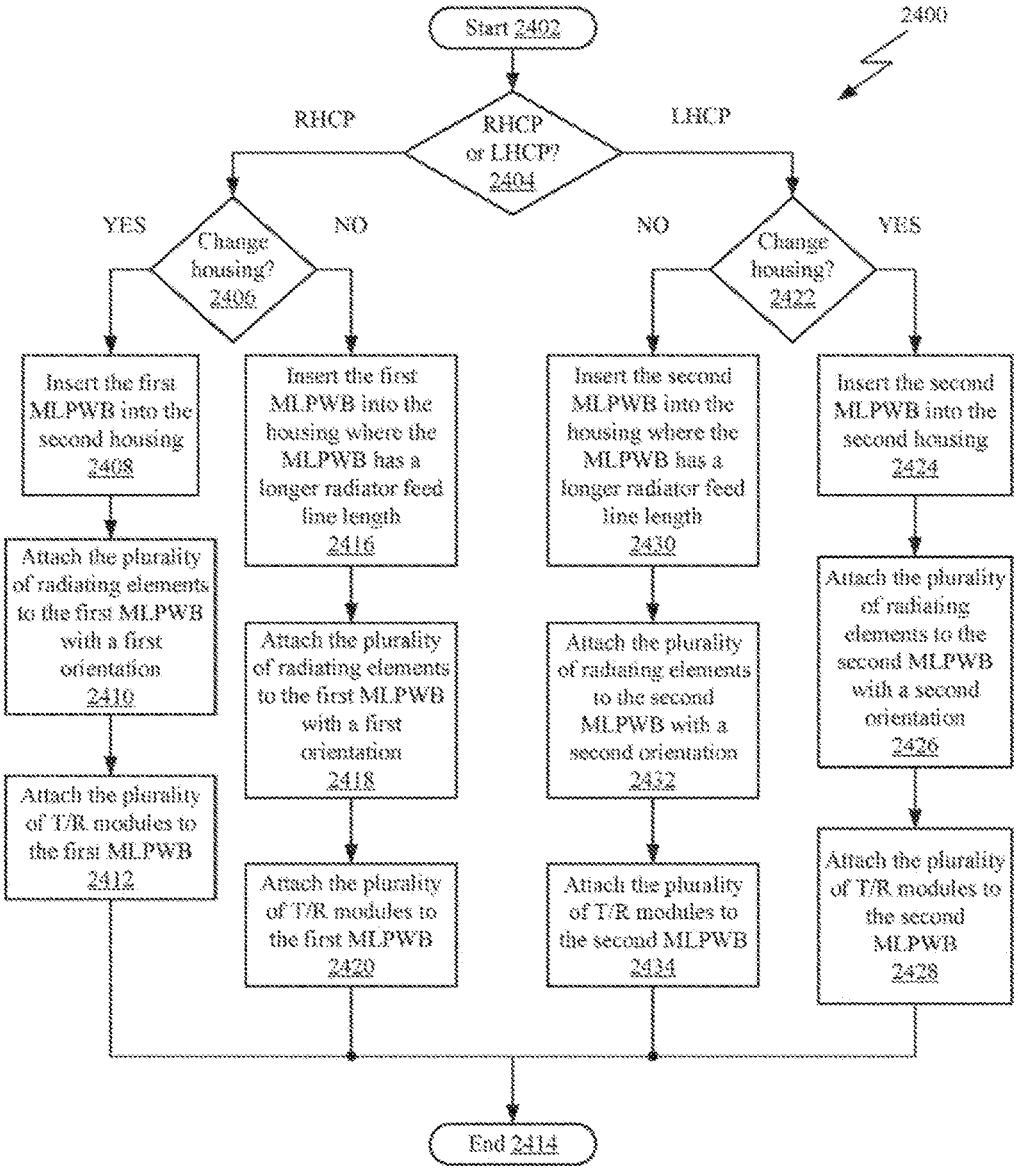
FIG. 24 is a flowchart of an example of an implementation of a process for fabricating the STRPAA in accordance with the present invention.

Turning to FIG. 24, a flowchart 2400 is shown of an example of an implementation of a process for fabricating the STRPAA in accordance with the present invention. The process starts 2402 by determining if the STRPAA will be configured to operate with a first elliptical polarization (such as, for example, RHCP or LHCP) or a second elliptical polarization (such as, for example, LHCP or RHCP). For this example, the first elliptical polarization will be assumed to be RHCP and the second elliptical polarization will be assumed to be LHCP. If the STRPAA is to be configured to utilize RHCP, the process then determines if a previous run of the process (not shown) utilized a first housing and if the first housing needs to be changed for a second housing, step 2406. For example, if the previous run of the process produced a STRPAA configured to operate utilizing LHCP, the process determines if on top of changing the MLPWB, if the housing also has to change because the resulting mirrored (i.e., the rotated or "flipped") radiating elements are now in a position along the new MLPWB that is different than the original positions of the radiating elements along the previous MLPWB. Because these positions directly correspond to the channel openings in the honeycomb aperture plate, the new positions of the radiating elements on the new MLPWB will not line up properly with the channels of the honeycomb aperture plate. As such, a new honeycomb aperture plate will be needed to properly align with the radiating elements on the new MLPWB. Since the honeycomb aperture is part of the housing, the previous housing will need to be replaced with a new housing that has a honeycomb aperture plate that has channels that align with the radiating elements on the new MLPWB.

Therefore, if a new housing is needed, the process changes the housing and continues to step 2408 where the first MLPWB is inserted into the second housing. The plurality of radiating elements are then attached to the first MLPWB in step 2410. In this example, plurality of radiating elements are attached to the first MLPWB with an initial orientation (i.e., the predetermined azimuth position or angle) that is determined by the design of the STRPAA. The plurality of T/R modules are then also attached to the first MLPWB in step 2412. In this example, the plurality of radiating elements are attached to the first MLPWB front surface and the plurality of T/R modules are attached to the first MLPWB bottom surface, where the positions of the plurality of radiator feed points to the rotated plurality of radiating elements does not change with the second housing from the original location of the plurality of radiator feed points of the non-rotated radiator elements on the previous MLPWB top surface. The process then closes the second housing and the process ends 2414.

If, instead, a new housing in not needed or is not desirable, the process instead goes to step 2416. Example situations where the new housing is not desirable include situations where rotating the plurality of radiating elements causes a shift in the plurality of channels in the honeycomb aperture plate that causes a sizing issue because the mirror rotation of the individual radiating elements cause a shift in the position of radiating element that is mirrored about the radiating feed point of the radiating element (will be discussed in relation to FIG. 26). In this example, the process maintains the use of a housing that is configured as the previous housing and inserts the first MLPWB into the first housing. In this example, the first MLPWB includes an added radiator feed line length that is added to the feed probes from the first MLPWB to the individual radiating elements. This added radiator feed line length adds line length (with an associated phase delay) to the feed probes so as to feed the rotated radiating elements that are now in the same position as the original radiating elements but rotated about 180 degrees (i.e., flipped) but that now have radiator feed points that have been resulting shifted to the other side of the corresponding channel within the honeycomb aperture plate. As such, the added radiator feed line length is the needed line length to feed the radiating element from the feed probe from the first MLPWB. The actual value of length of the radiator feed line length is based on the design of the radiating elements but is generally close to but less than the length of the diameter of the radiating element and channel. As an example, if the radiating elements are circular (as shown in FIG. 6), the radiating elements have a feed point at a certain location within the circle defining the radiating element. The radiator feed line length would be approximately equal to the distance between the original feed points in the circle of the radiating element and its mirrored feed points inside the same circle. Since the STRPAA is a phased array, only the relative phase difference of the radiating elements matter in forming the proper radiation pattern. As such, the additional phase caused by the added radiator feed line length to each of the radiating elements would generally not have to be compensated.

The plurality of radiating elements are then attached to the first MLPWB in step 2418. Again, in this example, plurality of radiating elements are attached to the first MLPWB with an initial orientation that is determined by the design of the STRPAA. The plurality of T/R modules are then also attached to the first MLPWB in step 2420. In this example, the plurality of radiating elements are attached to the first MLPWB front surface and the plurality of T/R modules are attached to the first MLPWB bottom surface, where the positions of the plurality of radiator feed points to the rotated plurality of radiating elements does not change with the second housing from the original location of the plurality of radiator feed points of the non-rotated radiator elements on the previous MLPWB top surface. The process then closes the second housing and the process ends 2414.

If, instead, the STRPAA is to be configured to utilize LHCP, the process then determines if a previous run of the process (not shown) utilized a first housing and if the first housing needs to be changed for a second housing, step 2422. Again, as an example, if the previous run of the process produced a STRPAA configured to operate utilizing RHCP, the process determines if on top of changing the MLPWB, if the housing also has to change because the resulting mirrored radiating elements are now in a position along the new MLPWB that is different than the original positions of the radiating elements along the previous MLPWB for the reasons described earlier.

Therefore, if a new housing is needed, the process changes the housing and continues to step 2424 where the second MLPWB is inserted into the second housing. The plurality of radiating elements are then attached to the second MLPWB in step 2426. In this example, plurality of radiating elements are attached to the second MLPWB with an orientation that is approximately 180 from the original orientation (i.e., the predetermined azimuth position or angle) that is determined by the design of the STRPAA. The plurality of T/R modules are then also attached to the second MLPWB in step 2428. In this example, the plurality of radiating elements are attached to the second MLPWB front surface and the plurality of T/R modules are attached to the second MLPWB bottom surface, where the positions of the plurality of radiator feed points to the rotated plurality of radiating elements does not change with the second housing from the original location of the plurality of radiator feed points of the non-rotated radiator elements on the previous MLPWB top surface. The process then closes the second housing and the process ends 2414.

If, instead, a new housing in not needed or is not desirable, the process instead goes to step 2430. As discussed previously, example situations where the new housing is not desirable include situations where rotating the plurality of radiating elements causes a shift in the plurality of channels in the honeycomb aperture plate that causes a sizing issue because the mirror rotation of the individual radiating elements. In this example, the process maintains the use of a housing that is configured as the previous housing and inserts the second MLPWB into the first housing in step. Similar to before, in this example, the second MLPWB includes an added radiator feed line length that is added to the feed probes from the second MLPWB to the individual radiating elements. Again, this added radiator feed line length adds line length to the feed probes so as to feed the rotated radiating elements that are now in the same position as the original radiating elements but rotated about 180 degrees (i.e., flipped) but that now have radiator feed points that have been resulting shifted to the other side of the corresponding channel within the honeycomb aperture plate. As such, the added radiator feed line length is the needed line length to feed the radiating element from the feed probe from the first MLPWB.

The plurality of radiating elements are then attached to the second MLPWB in step 2432. Again, in this example, the plurality of radiating elements are attached to the second MLPWB with an initial orientation that is determined by the design of the STRPAA. The plurality of T/R modules are then also attached to the second MLPWB in step 2434. In this example, the plurality of radiating elements are attached to the second MLPWB front surface and the plurality of T/R modules are attached to the second MLPWB bottom surface, where the positions of the plurality of radiator feed points to the rotated plurality of radiating elements does not change with the first housing from the original location of the plurality of radiator feed points of the non-rotated radiator elements on the previous MLPWB top surface. The process then closes the second housing and the process ends 2414.

In this example, inserting the first MLPWB into the housing (in steps 2408 and 2416) includes inserting the first MLPWB into a first housing that has a first honeycomb aperture plate that is configured to produce the first elliptical polarization. As described earlier, the first housing includes a first pressure plate and the first honeycomb aperture plate has a plurality of channels. The first pressure plate is configured to push the plurality of T/R modules against the first MLPWB bottom surface and the plurality of radiating elements are configured to be placed approximately against the first honeycomb aperture plate. Each radiating element of the plurality of radiating elements is located at a corresponding channel of the plurality of channels of the first honeycomb aperture.

Similarly, inserting the second MLPWB into the housing includes inserting the second MLPWB into a second housing that has a second honeycomb aperture plate that is configured to produce the first elliptical polarization.

The second housing includes a second pressure plate and the second honeycomb aperture plate having a plurality of channels. The second pressure plate is configured to push the plurality of T/R modules against the second MLPWB bottom surface and the plurality of radiating elements are configured to be placed approximately against the second honeycomb aperture plate. Each radiating element of the plurality of radiating elements is located at a corresponding channel of the plurality of channels of the second honeycomb aperture.

In this example, the second housing is separate from the first housing and the plurality of channels in the second honeycomb aperture are shifted to a new position with relation to an original position of the plurality of chancel in the first honeycomb aperture. The new position of the plurality of channels in the second honeycomb aperture is located such that a plurality of radiator feed points to the rotated plurality of radiating elements does not change with the second housing from a location of the plurality of radiator feed points to the originally attached and non-rotated radiator elements in the first housing.

Additionally, in this example, attaching the radiating elements to the first MLPWB top surface of the first MLPWB includes placing the plurality of rotated radiating elements approximately against the first honeycomb aperture plate and attaching the T/R modules to the first MLPWB bottom surface of the first MLPWB includes pressing the plurality of T/R modules against the first MLPWB bottom surface.

Figure 25:
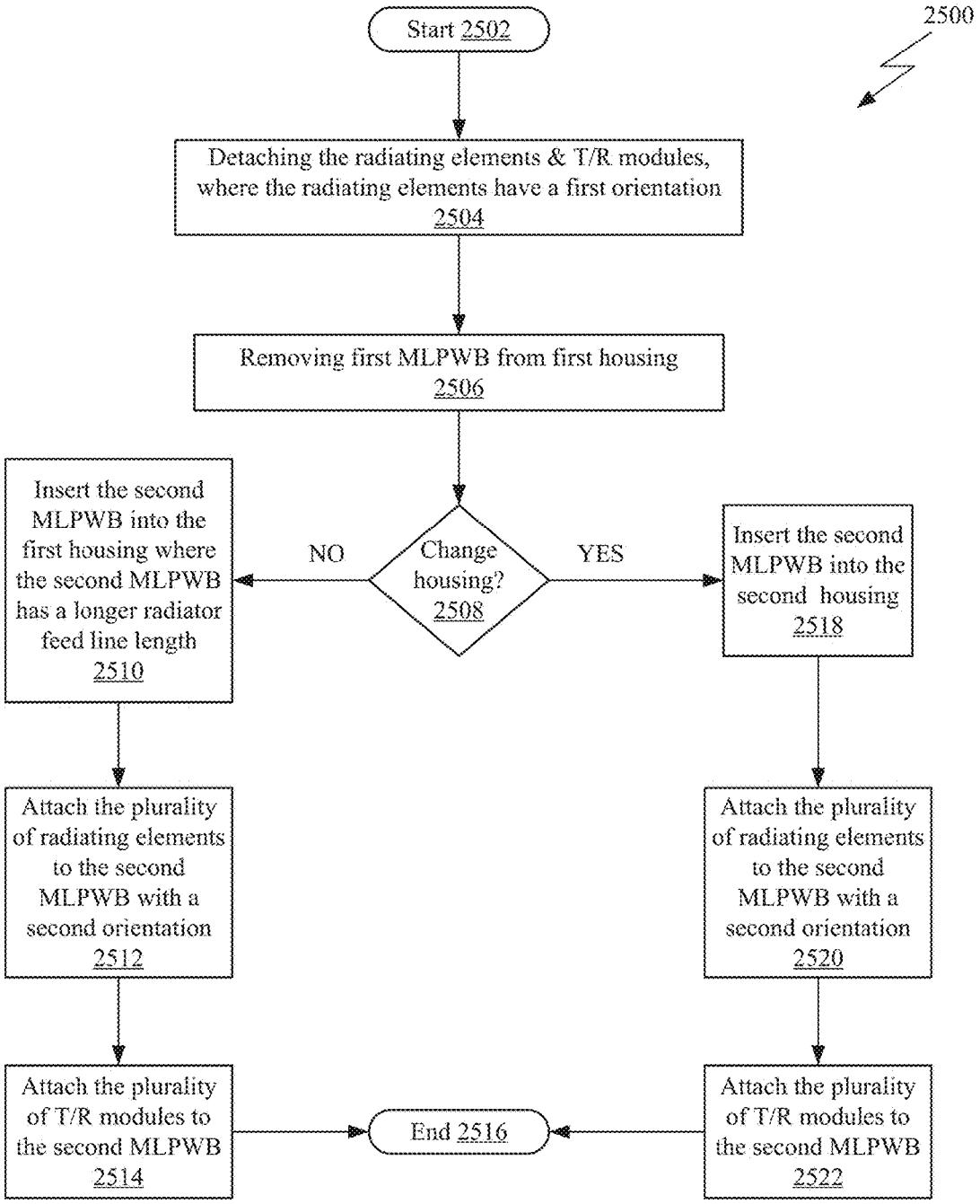
FIG. 25 is a flowchart of an example of an implementation of a process for converting an existing STRPAA from a first elliptical polarization to a second elliptical polarization in accordance with the present invention.

In FIG. 25, a flowchart 2500 is shown of an example of an implementation of a process for converting an existing STRPAA from a first elliptical polarization to a second elliptical polarization in accordance with the present invention. In this example, the STRPAA is assumed to be a fabricated STRPAA that is configured to operate in with a first elliptical polarization (such as, for example, either RHCP or LHCP). The desire in this example is to change the polarization of the STRPAA from operating with a first to a second polarization. The process starts 2502 and in step 2504, the original housing of the STRPAA is opened and both the radiating elements and T/R modules are detached from the original MLPWB in the original housing. The original (i.e., the first) MLPWB is then removed from the original housing in step 2506 and it is determined in decision step 2508 if the original housing needs to be changed to a new housing. The reason for having to change the housing has been described earlier in this disclosure. If the original housing does not have be changed (or it is not necessary but simply it is not desired), the second MLPWB in inserted into the original housing in step 2510 where the second MLPWB includes a longer radiator feed line length than the original MLPWB. The plurality of radiating elements are then attached, in step 2512, to the second MLPWB where the plurality of radiating elements are rotated to a new angular position (i.e., a second orientation) with regard to the original orientation that the plurality of radiating elements had in the housing with the original MLPWB. In this example, the second orientation is approximately 180 degrees in rotation from the original orientation. The plurality of T/R modules are then attached to the second MLPWB in step 2514, the housing is closed, and the process ends 2516.

If, instead, the original housing is changed for a new housing, the process proceeds to step 2518 where the second MLPWB is inserted into the new housing. The plurality of radiating elements are then attached to the second MLPWB, in step 2520, with the second orientation that is approximately 180 degrees in rotation from the original orientation of the plurality of radiating elements that were attached to the first MLPWB in the original housing. The plurality of T/R modules are then attached to the second MLPWB in step 2522, the new housing is closed, and the process ends 2516.

In this example, inserting the first MLPWB into the housing (in step 2510) includes inserting the second MLPWB into a first housing that has a first honeycomb aperture plate that is configured to produce the first elliptical polarization. As described earlier, the first housing includes a first pressure plate and the first honeycomb aperture plate has a plurality of channels. The first pressure plate is configured to push the plurality of T/R modules against the first MLPWB bottom surface and the plurality of radiating elements are configured to be placed approximately against the first honeycomb aperture plate. Each radiating element of the plurality of radiating elements is located at a corresponding channel of the plurality of channels of the first honeycomb aperture.

Similarly, inserting the second MLPWB into the second housing (step 2518) includes inserting the second MLPWB into a second housing that has a second honeycomb aperture plate that is configured to produce the first elliptical polarization.

The second housing includes a second pressure plate and the second honeycomb aperture plate having a plurality of channels. The second pressure plate is configured to push the plurality of T/R modules against the second MLPWB bottom surface and the plurality of radiating elements are configured to be placed approximately against the second honeycomb aperture plate. Each radiating element of the plurality of radiating elements is located at a corresponding channel of the plurality of channels of the second honeycomb aperture.

In this example, the second housing is separate from the first housing and the plurality of channels in the second honeycomb aperture are shifted to a new position with relation to an original position of the plurality of chancel in the first honeycomb aperture. The new position of the plurality of channels in the second honeycomb aperture is located such that a plurality of radiator feed points to the rotated plurality of radiating elements does not change with the second housing from a location of the plurality of radiator feed points to the originally attached and non-rotated radiator elements in the first housing.

Additionally, in this example, attaching the radiating elements to the first MLPWB top surface of the first MLPWB includes placing the plurality of rotated radiating elements approximately against the first honeycomb aperture plate and attaching the T/R modules to the first MLPWB bottom surface of the first MLPWB includes pressing the plurality of T/R modules against the first MLPWB bottom surface.

Tuning to FIGS. 26A, 26B, 26C, and 26D, different views are shown of a radiating element from the plurality of radiating elements in accordance the present invention. In these examples, the radiating element 2600 is assumed to be, for example, the same type of radiating element 600 as described in FIG. 6.

As described earlier, in this example, the radiating element 2600 is formed and/or etched on the top surface of an MLPWB. As described in FIGS. 4, 5, and 6, the radiating element 2600 may include a first radiator 2602 and second radiator 2604. The first radiator 2602 is fed by at a first feed point 2606 that is fed by a first probe 2608 that is in signal communication with the T/R module (not shown) and the second radiator 2604 is fed by a second feed point 2610 that is fed by a second probe 2612 that is also in signal communication with the T/R module (not shown) as previously described in FIGS. 4, 5, and 6. As described previously, the first radiator 2602 may radiate a first type of polarization (such as, for example, vertical polarization or RHCP) and the second radiator 2604 may radiate a second type of polarization (such as, for example, horizontal polarization or LHCP) that is orthogonal to the first polarization. When combined, the first and second radiators 2602 and 2604 may produce the first elliptical or second elliptical polarization. Also shown in this example is grounding element 2614, or elements, described in FIGS. 4 and 6. The grounding element(s) 2614 may include a plurality of contact pads (not shown) that protrude out from the top surface (not shown) of the MLPWB to engage the bottom surface (not shown) of the honeycomb aperture plate (not shown) to properly ground the walls of the channel (not shown) that is located adjacent to the radiating element 2600. Additionally, a ground via (not shown but similar to the ground via shown in FIG. 6) may be radiating element 2600 to help tune the radiator bandwidth.

Figure 26A:
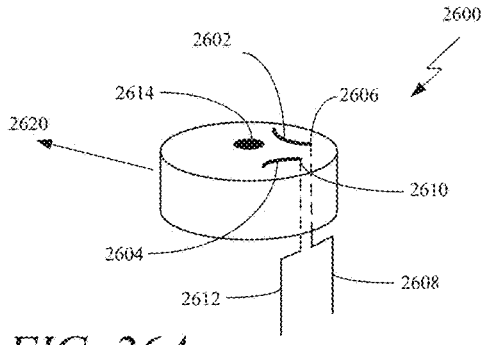
FIG. 26A is a perspective-view of the radiating element with the first and second probes and attached to the radiating elements in accordance with the present invention.
Figure 26C:
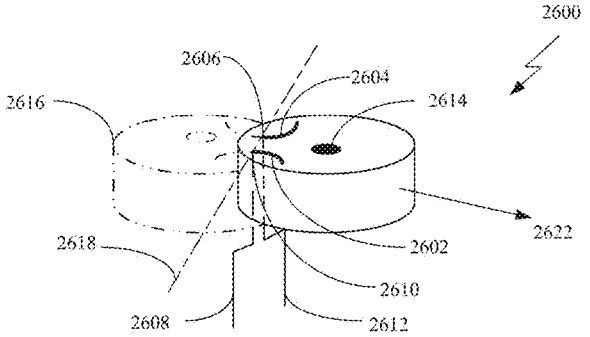
FIG. 26C is a perspective-view of the radiating element show in (FIGS. 26A and 26B) in a new flipped position that is mirrored along a mirror axis from the original position and pointing in the new second direction in accordance with the present invention.
Figure 26B:
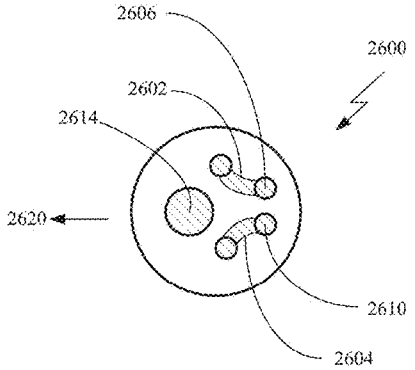
FIG. 26B is a top-view of the radiating element show in FIG. 26A in accordance with the present invention.
Figure 26D:
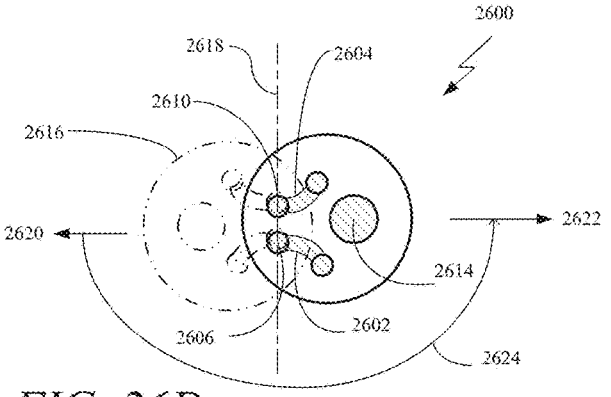
FIG. 26D is a top-view of the flipped (i.e., mirror and rotated) radiating element show in FIG. 26C in accordance with the present invention.
Figure 26E:
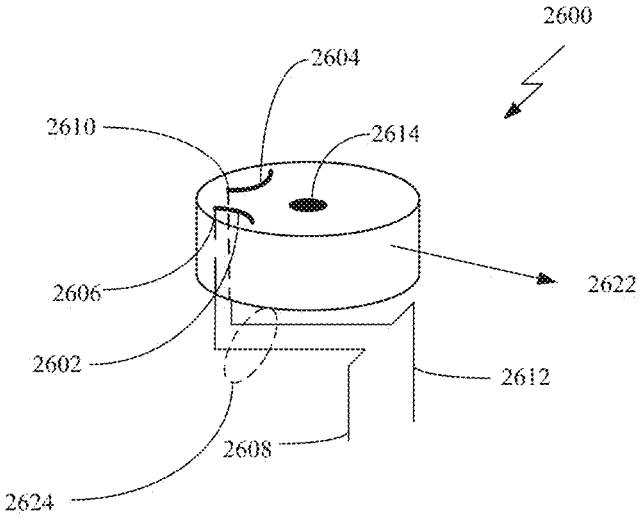
FIG. 26E is a perspective-view of the radiating element (shown in FIGS. 26C and 26D) having longer radiator feed line length that has been added to the first and second probes and 2612 in accordance with the present invention.

In this example, FIG. 26A shows a perspective-view of the radiating element 2600 with the first and second probes 2608 and 2612 attached to the radiating elements 2600. FIG. 26B shows a top-view of the radiating element 2600. Both FIGS. 26A and 26B, show the radiating element 2600 in an unflipped position with an original orientation pointing in a first direction 2620. In FIGS. 26C and 26D, the radiating element 2600 is shown in a flipped (i.e., mirrored) position with a new orientation pointing in a second direction 2622 where the radiating element 2600 has been flipped to the opposite side. Turning to FIG. 26C, a perspective-view of the radiating element 2600 is shown in a new flipped position that is mirrored along a mirror axis 2618 from the original position 2616 and pointing in the new second direction 2622. In FIG. 26D, a top-view of the flipped (i.e., mirror and rotated) radiating element 2600 is shown. In this view, it is appreciated that the radiating element 2600 have been flipped along the mirrored axis 2618 to have a new orientation that points in a new direction 2622 where the new direction 2622 is basically a rotated angle 2624 from the original direction 2620 of the original orientation that is equal to approximately 180 degrees. In FIG. 26E, a perspective-view of radiating element 2600 is shown having longer radiator feed line length 2624 that has been added to the first and second probes 2608 and 2612. This added radiator feed line length 2624 is typically incorporated within the MLPWB.

It will be understood that various aspects or details of the disclosure may be changed without departing from the scope of the disclosure. It is not exhaustive and does not limit the claimed disclosures to the precise form disclosed. Furthermore, the foregoing description is for the purpose of illustration only, and not for the purpose of limitation. Modifications and variations are possible in light of the above description or may be acquired from practicing the disclosure. The claims and their equivalents define the scope of the disclosure.

What is claimed is:

1. A method for converting a switchable transmit and receive phased array antenna ("STRPAA") from a first elliptical polarization to a second elliptical polarization, wherein the STRPAA has a housing, a first multilayer printed wiring board ("MLPWB") within the housing, a plurality of radiating elements attached to a first MLPWB top surface of the MLPWB within the housing, and a plurality of transmit and receive ("T/R") modules attached to a first MLPWB bottom surface of the first MLPWB within the housing, wherein the first MLPWB is configured to produce a first elliptical polarization, the method comprising:

detaching the radiating elements and T/R modules from the first MLPWB;

removing the first MLPWB from the housing;

inserting a second MLPWB into the housing, wherein the second MLPWB is configured to produce a second elliptical polarization;

attaching the detached radiating elements to a second MLPWB top surface of the second MLPWB; and attaching the detached T/R modules to a second MLPWB bottom surface of the second MLPWB.

2. The method of claim 1, further including rotating each detached radiating element, of the radiating elements, by approximately 180 degrees in azimuth prior to attaching the detached radiating element to the second MLPWB top surface.

3. The method of claim 2, wherein the second MLPWB introduces a radiator feed additional line length to each re-attached radiating element of the plurality of radiating elements, wherein the radiator feed additional line length is longer than an original feed line length from the first MLPWB to each originally attached radiating element of the plurality of radiating elements.

4. The method of claim 3, wherein the first elliptical polarization is right-hand circular polarization ("RHCP") and the second elliptical polarization is left-hand circular polarization ("LHCP") or the first elliptical polarization is LHCP and the second elliptical polarization is RHCP.

5. The method of claim 2, further including replacing the housing with a second housing prior to placing the second MLPWB into the housing, wherein the housing is a first housing having the first MLPWB, plurality of radiating elements, and plurality of T/R modules, wherein placing the second MLPWB into the housing includes placing the second MLPWB within the second housing that is separate from the first housing, wherein the first housing includes a first pressure plate and a first honeycomb aperture plate having a plurality of channels, wherein the first pressure plate is configured to push the plurality of T/R modules against the first MLPWB bottom surface, wherein the plurality of radiating elements are configured to be placed approximately against the first honeycomb aperture plate, and wherein each radiating element of the plurality of radiating elements is located at a corresponding channel of the plurality of channels of the first honeycomb aperture, wherein the second housing includes a second pressure plate and a second honeycomb aperture plate having a plurality of channels, wherein the second pressure plate is configured to push the plurality of T/R modules against the second MLPWB bottom surface, wherein the plurality of radiating elements are configured to be placed approximately against the second honeycomb aperture plate, and wherein each radiating element of the plurality of radiating elements is located at a corresponding channel of the plurality of channels of the second honeycomb aperture, wherein the plurality of channels in the second honeycomb aperture are shifted to a new position with relation to an original position of the plurality of chancel in the first honeycomb aperture, and wherein the new position of the plurality of channels in the second honeycomb aperture is located such that a plurality of radiator feed points to the rotated plurality of radiating elements does not change with the second housing from a location of the plurality of radiator feed points to the originally attached and non-rotated radiator elements in the first housing.

6. The method of claim 5, wherein attaching the detached radiating elements to the second MLPWB top surface of the second MLPWB includes attaching the rotated radiating elements to the second MLPWB top surface of the second MLPWB and placing the plurality of rotated radiating elements approximately against the second honeycomb aperture plate, and wherein attaching the detached T/R modules to the second MLPWB bottom surface of the second MLPWB includes pressing the plurality of T/R modules against the second MLPWB bottom surface.

7. The method of claim 6, wherein the first elliptical polarization is right-hand circular polarization ("RHCP") and the second elliptical polarization is left-hand circular polarization ("LHCP") or the first elliptical polarization is LHCP and the second elliptical polarization is RHCP.

8. A method for fabricating a switchable transmit and receive phased array antenna ("STRPAA") with either a first elliptical polarization or a second elliptical polarization, wherein the STRPAA is fabricated from components that include a housing, a plurality of radiating elements, a plurality of transmit and receive ("T/R") modules, a first multilayer printed wiring board ("MLPWB"), and a second MLPWB, wherein the first MLPWB is configured to produce the first elliptical polarization and the second MLPWB is configured to produce the second elliptical polarization, the method including:

inserting into the housing either the first MLPWB to configure the STRPAA to produce the first elliptical polarization or the second MLPWB to configure the STRPAA to produce the second elliptical polarization;

attaching the plurality of radiating elements either to a first MLPWB top surface of the first MLPWB if the first MLPWB is inserted in the housing, wherein the plurality of radiating elements are attached to the first MLPWB top surface at a predetermined azimuth position or to a second MLPWB top surface of the second MLPWB if the second MLPWB is inserted in the housing wherein attaching the plurality of radiating elements includes rotating each element of the plurality of radiating elements, by approximately 180 degrees in azimuth, from the predetermined azimuth position, prior to attaching the plurality of radiating elements to the second MLPWB top surface; and attaching the plurality of T/R modules either to a first MLPWB bottom surface of the first MLPWB if the first MLPWB is inserted in the housing or to a second MLPWB bottom surface of the second MLPWB if the second MLPWB is inserted in the housing.

9. The method of claim 8, wherein the first MLPWB introduces a first radiator feed line length to each attached radiating element of the plurality of radiating elements attached to the first MLPWB top surface, wherein the second MLPWB introduces a second radiator feed line length to each attached radiating element of the plurality of radiating elements attached to the second MLPWB top surface, and wherein the second radiator feed line length is longer than an the first feed line length.

10. The method of claim 9, wherein the first elliptical polarization is right-hand circular polarization ("RHCP") and the second elliptical polarization is left-hand circular polarization ("LHCP") or the first elliptical polarization is LHCP and the second elliptical polarization is RHCP.

11. The method of claim 8, wherein inserting into the housing the first MLPWB includes inserting the first MLPWB into a first housing that has a first honeycomb aperture plate that is configured to produce the first elliptical polarization, wherein the first housing includes a first pressure plate and the first honeycomb aperture plate having a plurality of channels, wherein the first pressure plate is configured to push the plurality of T/R modules against the first MLPWB bottom surface, wherein the plurality of radiating elements are configured to be placed approximately against the first honeycomb aperture plate, and wherein each radiating element of the plurality of radiating elements is located at a corresponding channel of the plurality of channels of the first honeycomb aperture, wherein inserting into the housing the second MLPWB includes inserting the second MLPWB into a second housing that has a second honeycomb aperture plate that is configured to produce the first elliptical polarization, wherein the second housing includes a second pressure plate and the second honeycomb aperture plate having a plurality of channels, wherein the second pressure plate is configured to push the plurality of T/R modules against the second MLPWB bottom surface, wherein the plurality of radiating elements are configured to be placed approximately against the second honeycomb aperture plate, and wherein each radiating element of the plurality of radiating elements is located at a corresponding channel of the plurality of channels of the second honeycomb aperture, wherein the second housing is separate from the first housing;

wherein the plurality of channels in the second honeycomb aperture are shifted to a new position with relation to an original position of the plurality of chancel in the first honeycomb aperture, and wherein the new position of the plurality of channels in the second honeycomb aperture is located such that a plurality of radiator feed points to the rotated plurality of radiating elements does not change with the second housing from a location of the plurality of radiator feed points to the originally attached and non-rotated radiator elements in the first housing.

12. The method of claim 11, wherein attaching the radiating elements to the first MLPWB top surface of the first MLPWB includes placing the plurality of rotated radiating elements approximately against the first honeycomb aperture plate, and wherein attaching the T/R modules to the first MLPWB bottom surface of the first MLPWB includes pressing the plurality of T/R modules against the first MLPWB bottom surface.

13. The method of claim 12, wherein the first elliptical polarization is right-hand circular polarization ("RHCP") and the second elliptical polarization is left-hand circular polarization ("LHCP") or the first elliptical polarization is LHCP and the second elliptical polarization is RHCP.

14. The method of claim 11, wherein attaching the radiating elements to the second MLPWB top surface of the second MLPWB includes attaching the rotated radiating elements to the second MLPWB top surface of the second MLPWB and placing the plurality of rotated radiating elements approximately against the second honeycomb aperture plate, and wherein attaching the T/R modules to the second MLPWB bottom surface of the second MLPWB includes pressing the plurality of T/R modules against the second MLPWB bottom surface.

15. The method of claim 14, wherein the first elliptical polarization is right-hand circular polarization ("RHCP") and the second elliptical polarization is left-hand circular polarization ("LHCP") or the first elliptical polarization is LHCP and the second elliptical polarization is RHCP.

* * * * *